US010898921B2

(12) United States Patent
Zenou et al.

(10) Patent No.: US 10,898,921 B2
(45) Date of Patent: Jan. 26, 2021

(54) COATING APPARATUS HAVING A WELL-DEFINIED GAP FOR CONTROLLING THICKNESS OF A LAYER OF RHEOLOGICAL MATERIAL APPLIED TO A FLEXIBLE FILM

(71) Applicant: IO Tech Group Ltd., London (GB)

(72) Inventors: Michael Zenou, Hashmonaim (IL); Ziv Gilan, Kfar-harif (IL)

(73) Assignee: IO Tech Group Ltd., London (GB)

( * ) Notice: Subject to any disclaimer, the term of this patent is extended or adjusted under 35 U.S.C. 154(b) by 0 days.

(21) Appl. No.: 16/694,616

(22) Filed: Nov. 25, 2019

(65) Prior Publication Data

US 2020/0086341 A1 Mar. 19, 2020

Related U.S. Application Data

(62) Division of application No. 16/292,599, filed on Mar. 5, 2019, now Pat. No. 10,603,684.
(Continued)

(51) Int. Cl.
*B05C 11/10* (2006.01)
*B05C 5/02* (2006.01)
(Continued)

(52) U.S. Cl.
CPC ..... *B05D 1/26* (2013.01); *B05C 1/0882* (2013.01); *B05C 5/0225* (2013.01);
(Continued)

(58) Field of Classification Search
CPC ..... B05C 11/025–028
See application file for complete search history.

(56) References Cited

U.S. PATENT DOCUMENTS 2,089,525 A * 8/1937 Abrams ..... B05C 11/025 118/117
4,456,637 A * 6/1984 Takeda ..... B05C 1/0839 118/118

(Continued)

FOREIGN PATENT DOCUMENTS

GB 802682 A 10/1958
WO 00/29126 A1 5/2000

OTHER PUBLICATIONS

International Search Report and Written Opinion dated Jun. 26, 2019, from the ISA/European Patent Office, for International Application No. PCT/IB2019/051775 (filed Mar. 5, 2019), 13 pages.

*Primary Examiner* — Binu Thomas
(74) *Attorney, Agent, or Firm* — Ascenda Law Group, PC

(57) ABSTRACT

Systems and methods for dispensing liquid materials as may be used in applications for coating flexible films and the like. Such a film may be coated by dispensing a rheological material onto its surface while drawing the film through a gap between a pair of rollers. The gap defines the thickness of a layer of the material applied to the film and is maintained at a desired width by microwires positioned through the gap. Another film across the gap from that to which the rheological material is applied aids in the coating of the layer and a contact area of the second film may be adjusted relative to the gap, e.g., when changing materials or when the coating film becomes abraded or deformed.

12 Claims, 20 Drawing Sheets

Related U.S. Application Data

(60) Provisional application No. 62/643,263, filed on Mar. 15, 2018.

(51) Int. Cl.

| | |
|---|---|
| ***B05C 1/08*** | (2006.01) |
| ***B05D 1/26*** | (2006.01) |
| ***B05D 1/40*** | (2006.01) |
| ***B05D 7/00*** | (2006.01) |
| ***B05C 11/02*** | (2006.01) |

(52) U.S. Cl.

CPC ..... *B05C 5/0279* (2013.01); *B05C 11/025* (2013.01); *B05C 11/026* (2013.01); *B05C 11/1005* (2013.01); *B05D 1/40* (2013.01); *B05D 7/52* (2013.01); *B05C 1/0895* (2013.01); *B05D 2252/02* (2013.01)

(56) References Cited

U.S. PATENT DOCUMENTS

| | | | | |
|---|---|---|---|---|
| 5,281,435 | A | 1/1994 | Buecher | |
| 6,471,776 | B1 | 10/2002 | Krossa et al. | |
| 2002/0094384 | A1* | 7/2002 | Leonard | B05C 5/0208 118/209 |
| 2013/0260017 | A1* | 10/2013 | Yamazaki | B05C 1/0808 118/258 |

* cited by examiner

COATING APPARATUS HAVING A WELL-DEFINIED GAP FOR CONTROLLING THICKNESS OF A LAYER OF RHEOLOGICAL MATERIAL APPLIED TO A FLEXIBLE FILM

RELATED APPLICATIONS

This is a DIVISIONAL of U.S. application Ser. No. 16/292,599, filed 5 Mar. 2019, which is a NONPROVISIONAL of and claims priority to U.S. Provisional Application No. 62/643,263, filed 15 Mar. 2018, each of which are incorporated herein by reference.

FIELD OF THE INVENTION

The present invention relates generally to systems and methods for dispensing liquid materials, for example, as may be used in applications for coating flexible films and the like, and in particular such systems as are configured for dispensing multiple liquid materials from multiple reservoirs.

BACKGROUND

There exist many systems for the dispensing of liquid materials onto substrates. Generally, two regimes for such dispensing apparatus exist: "drop on demand" and "continuous." In a drop-on-demand regime, the substrate is coated with material that is dispensed in the form of individual droplets delivered from a nozzle. In a continuous coating regime, the material is dispensed onto the substrate in a continuous flow. Regardless of the dispensing method, it is typically the case that precision control over dispensing pressures are required. Different materials to be dispensed require different dispensing pressures due to their differing rheological properties. Consequently, it is difficult to employ a single dispensing apparatus in connection with a wide range of liquid materials.

SUMMARY

Embodiments of the present invention provide for the dispensing of a precise amount of liquid material, with constant volume and at tunable frequencies, without high tolerance requirements on the pressures used for such dispensing or on the materials being dispensed. Systems configured in accordance with the present invention are characterized by relatively fast open/close switch times, which enable rapid switching between materials for dispensing. The dispensing is accomplished by two separate liquid flow mechanisms, one being an imprecise pressure transfer dispenser, and the other a piston transfer mechanism. In one embodiment, the dispensing system may be used within an apparatus for coating thin and precise layers of rheological material on a flexible film. In such apparatus, the thickness of the layer applied to the film is controlled by the separation distance or gap between two rollers, with the gap width being maintained by two or more microwires disposed in the gap between the rollers. The coating apparatus may also be used without the multi-material dispensing system, e.g., when only a single material is being deposited on the film, and may, in some embodiments, utilize a conventional syringe as a dispenser. Accordingly, aspects of the multi liquid dispensing system and the coating system will be described separately as well as in combination with one another.

In one embodiment of the invention, a coating apparatus includes a dispensing unit arranged to apply rheological material on a flexible film. The film is arranged so as to be drawn through a gap between a pair of rollers of the coating apparatus. The gap defines a thickness of a layer of rheological material applied to the film by being positioned after a coating area in which the rheological material is applied to the film in a direction of film travel. The gap has a width maintained at a desired separation distance between the rollers by microwires suspended through the gap.

The coating apparatus may include a plurality of microwire holders mounted on rack that is slidably secured to a first track formed of one or more rails and secured to a rail holder such that a selected microwire holder with a microwire having a desired thickness is positionable adjacent to the gap between the pair of rollers. Each microwire holder may be displaceable along respective second tracks in a direction perpendicular to an extent of the first track. In such arrangements, each microwire holder may include a holder frame to which drums and wire supports are mounted, one end of a respective microwire of each microwire holder being secured to a respective first drum and another end of the respective microwire being secured to a respective second drum, with a middle portion of the respective microwire being supported by wire supports, such that rotation of respective first and second drums about respective axes of rotation adjusts tension of the respective microwire. The gap width is then defined by two microwire sub-assemblies, each microwire sub-assembly including racks linearly translatable along rails so as to position selected microwire holders having microwires of desired thickness adjacent to surfaces of said rollers.

In various embodiments of the invention, the microwires may be suspended through the gap and in contact with the film, in contact with one of the rollers, but not the film, or in contact with each of the pair of rollers but not the film.

Further, the film to which the rheological material is applied may be opposed across the gap by a second film. Thus, the microwires may be suspended through the gap and in contact with the film to which the rheological material is applied and the second film, in contact with one of the rollers, but not the film to which the rheological material is applied, or in contact with each of the pair of rollers but not the film to which the rheological material is applied or the second film.

Another embodiment of the invention provides for coating a film by dispensing a first rheological material onto a surface of a flexible film while drawing the film through a gap between a pair of rollers. The gap defines a thickness of a layer of the rheological material applied to the film by being positioned after a coating area in which the rheological material is applied to the film in a direction of film travel, and is maintained at a width by positioning first microwires through the gap as the dispensing of the rheological material takes place.

As indicated above, the film to which the first rheological material is applied may be opposed across the gap by a second film and a contact area of the second film across the gap from the film to which the rheological material is applied may be adjusted. In some cases, after adjusting the contact area of the second film, a second rheological material is dispensed onto the surface of the flexible film.

During dispensing of the rheological material onto the film, the width of the gap may be adjusted by exchanging the first microwires for second microwires of different thickness than the first microwires through the gap. Thereafter, the contact area of the second film across the gap from the film to which the rheological material is applied may be adjusted. Or, the dispensing of the first rheological material may be paused while exchanging the first microwires for second microwires of different thickness than the first microwires through the gap, and, thereafter, the contact area of the second film across the gap from the film to which the rheological material is applied may be adjusted. In still other instances, dispensing of the first rheological material may be suspended in favor of dispensing a second rheological material onto the surface of the film, and adjusting the width of the gap by exchanging the first microwires for second microwires of different thickness than the first microwires through the gap.

In another embodiment of the invention, a dispensing unit for dispensing liquid material includes a hollow reservoir configured to accommodate a syringe and having an elongated nipple at one end of the reservoir, a piston including a shaft disposed therein, and a bracket adapted to receive the nipple of the reservoir and the piston. The nipple of the reservoir provides a fluid path for liquid material dispensed from the syringe when supported in said reservoir and the bracket is adapted to receive the nipple of the reservoir such that the fluid path for the liquid material is oriented towards a nozzle disposed in the bracket. The nipple also has holes disposed near an end thereof, and the bracket is adapted to receive the piston oriented with respect to the nipple of the reservoir such that the shaft of the piston is aligned with the holes in the nipple and the nozzle. The shaft is thereby displaceable through the holes in the nipple towards the nozzle.

In some embodiments, the bracket includes rail mounts adapted to interface with rails of a dispenser system. Further, the piston may include a nib at a its top and an air nipple positioned along its longitudinal length. A hollow shaft of the piston that extends through the shaft being in fluid communication with the air nipple. The dispensing unit may also include the syringe received within the reservoir, and the syringe may have a plunger and a cap.

A further embodiment of the invention provides a dispensing system have one or more of the above-described dispensing units. These dispensing units are arranged so as to be laterally displaceable along a length of the dispensing system defined by a lead screw. A first motor is configured to drive the lead screw clockwise or counterclockwise, thereby displacing the dispensing units along the length of the dispensing system. The dispensing system also includes means for selectively actuating pistons of the dispensing units so as to displace respective ones of the shafts of the pistons with respect to the nozzles of the brackets they are received in.

In various embodiments, the means for selectively actuating pistons of the dispensing units include a piston nib capture unit translatable within a piston capture block parallel to a longitudinal axis of respective ones of the pistons of the dispensing units. A second motor is coupled to rotate a piston displacement shaft clockwise or counterclockwise, and the piston displacement shaft has at one end thereof a piston displacement cam. The piston nib capture unit contains a cam recess to receive the piston displacement cam and also includes a slotted recess to receive a nib of a respective one of the shafts of the pistons when disposed over that respective shafts. Thus, when the piston displacement cam rotates with the piston displacement shaft, the piston nib capture unit is translated in a direction defined by the longitudinal axis of the pistons and any respective piston nib that is secured within the slotted recess of the piston nib capture unit is also translated along that respective piston's longitudinal axis.

The end of the piston displacement shaft may be offset from an axis of rotation of the piston displacement shaft and the piston displacement cam may be oval in shape. Preferably, the piston nib capture unit containing the cam recess is fixed so as to remain stationary along an axis orthogonal to the longitudinal axis of the respective ones of the pistons.

In some instances, the dispensing system includes a third motor coupled to rotate a piston stroke shaft, which has at one end a piston stroke cam positioned so as to engage a displaceable cam along the piston displacement shaft. The displaceable cam abuts a spring-loaded wedge connected to the piston displacement cam so that movement of the displaceable cam through engagement with the piston stroke cam forces open the wedge thereby moving a center of rotation of the piston displacement cam radially away from an axis of rotation of the piston displacement shaft. In this way, the length of the stroke of the piston shafts may be adjusted.

A further embodiment of the invention provides a process for dispensing materials. According to the process, one or more syringes are filled with liquid materials of interest and subsequently placed in respective ones of a plurality of reservoirs of a dispenser unit. Respective pressures of the syringes for dispensing droplets of the liquid materials of interest when respective piston shafts of pistons associated with the plurality of reservoirs are activated are set (e.g., by adjusting positions of respective plungers of the one or more syringes), and a control unit of the dispenser unit is programmed with a desired print pattern of the liquid materials of interest. The eccentricity of a piston displacement cam of the dispenser unit is set so as to define a piston shaft stroke length of the pistons. Thereafter, a printing operation according to the desired print pattern is run, wherein during that printing operation actuators coupled to the control unit effect dispensing of the liquid materials from the reservoirs by displacing the respective piston shafts of the pistons associated with the plurality of reservoirs along their longitudinal lengths, thereby creating said droplets of the liquid materials. The liquid materials of interest may be replaced as needed during the printing operation.

In one instance, displacement of each respective piston shaft is achieved by way of one of the actuators rotating a shaft, one end of which is offset from its axis of rotation, forcing a piston nib capture unit to be displaced in a direction parallel to an axis of the longitudinal lengths of the pistons as the shaft rotates. The piston nib capture unit captures a top nib of a selected respective piston in a slotted recess within which top nib is positioned as the piston nib capture unit moves, thereby causing movement of the shaft of the selected respective piston as well. Also, a second of the actuators may displace the plurality of reservoirs of the dispensing unit along a length of the dispensing unit between movements of the shafts of each selected respective piston by rotating a lead screw clockwise or counterclockwise. And, a third of the actuators may change the piston shaft stroke length by changing an offset distance of the end of shaft from its axis of rotation.

Yet another embodiment of the invention provides a coating apparatus having one or more dispensing units of the kind discussed above. The dispensing units are arranged so as to apply rheological material from syringes accommodated within respective hollow reservoirs of the dispensing units on a flexible film drawn between a pair of spools, under respective nozzles of the dispensing units and through a gap defined by a pair of rollers of the coating apparatus. The gap defines a thickness of a layer of rheological material applied to the film by being positioned after a coating area in which the rheological material from the syringes is applied to the film in a direction of film travel, and the gap is maintained at a desired separation distance between the rollers by microwires suspended through the gap. So as to allow for gap widths of different dimensions, a plurality of microwire holders may be mounted on rack, and the rack slidably secured to a first track formed of one or more rails secured to a rail holder such that a selected microwire holder with a microwire having a desired thickness is positionable adjacent to the gap between the pair of rollers.

Each microwire holder may be displaceable along respective second tracks in a direction perpendicular to an extent of the first track. Further, each microwire holder may include a holder frame to which drums and wire supports are mounted. In such instances, one end of a respective microwire of each microwire holder is secured to a respective first drum and another end of the respective microwire is secured to a respective second drum, with a middle portion of the respective microwire being supported by wire supports such that rotation of respective first and second drums about respective axes of rotation adjusts tension of the respective microwire. In still other embodiments, the gap may be defined by two microwire sub-assemblies, each including racks linearly translatable along rails so as to position selected microwire holders having microwires of desired thickness adjacent to surfaces of said rollers.

These and further embodiments of the invention are described in detail below.

BRIEF DESCRIPTION OF THE DRAWINGS

The present invention is illustrated by way of example, and not limitation, in the figures of the accompanying drawings, in which.

DETAILED DESCRIPTION

Figure 1:
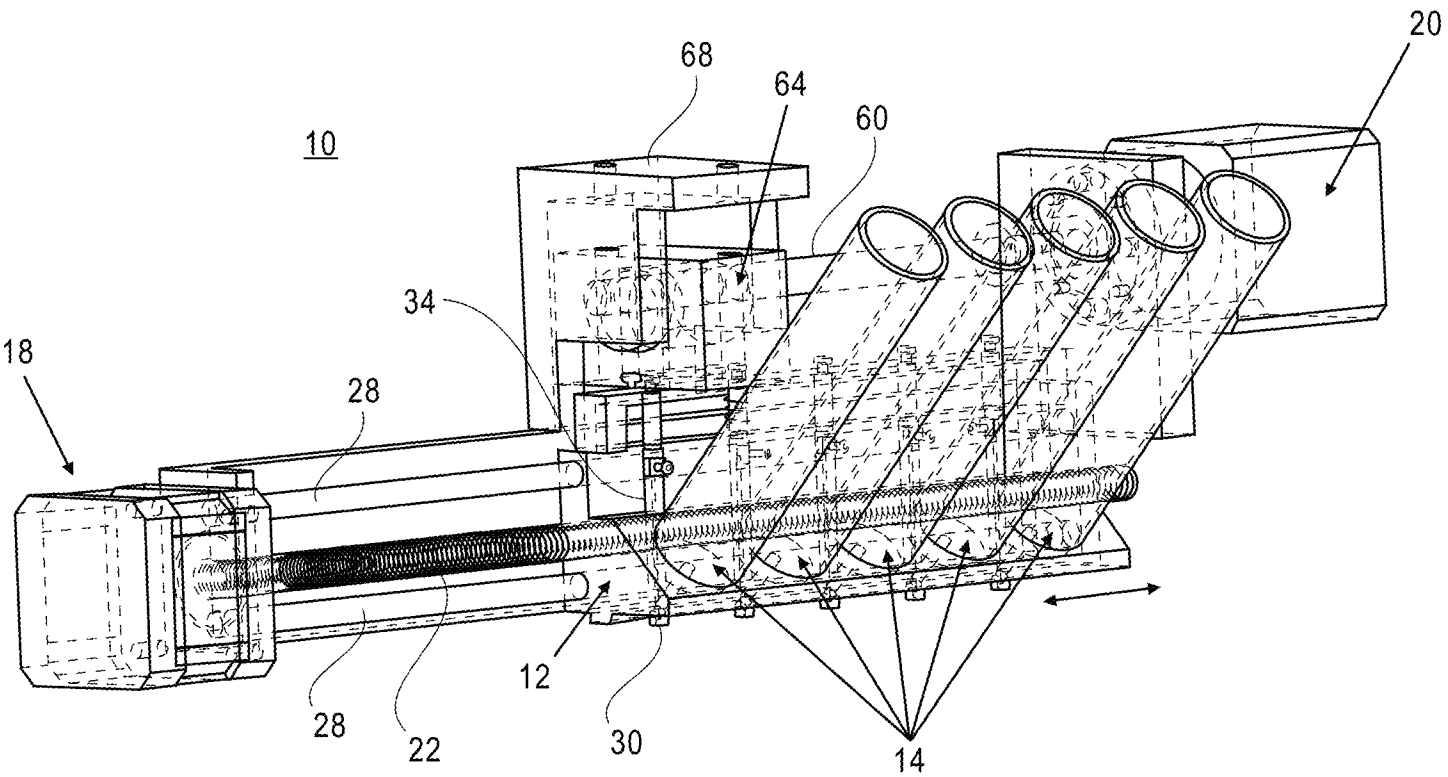
FIG. 1 shows an example of a multi-material dispensing system with a plurality of liquid reservoirs in accordance with an embodiment of the invention.

Referring first to FIG. 1, an example of a multi-material dispensing system 10 with a plurality of liquid reservoirs 14 is shown. Precision dispensers usually require complex control of the dispensing pressure, which tends to depend on the rheological properties of the material being dispensed. The present system simplifies the dispensing procedure, thereby enabling precise dispensing at tunable frequencies, without the usual, attendant demands on such a system. The modular nature of the present system also affords easy replacement of consumable components, thereby facilitating ease of maintenance. As compared to conventional dispensing systems, the present dispensing system offers:

- higher tolerances on pressure control (i.e., the present system does not require the same degree of precise control over the dispensing pressures as conventional units);
- less dependence on the rheological properties of the materials being dispensed;
- compactness, simplicity, and low cost;
- precise, high level control through a range of dispensing frequencies;
- fast switch open/close times;

a single system which serves as a valve or piston pump without additional sub-systems;

fast switching between materials for dispensation;

two dispensing regimes: "drop on demand" and "continuous" in a single unit; and direct control of the dispenser head for unidimensional droplet positioning.

Figure 2A:
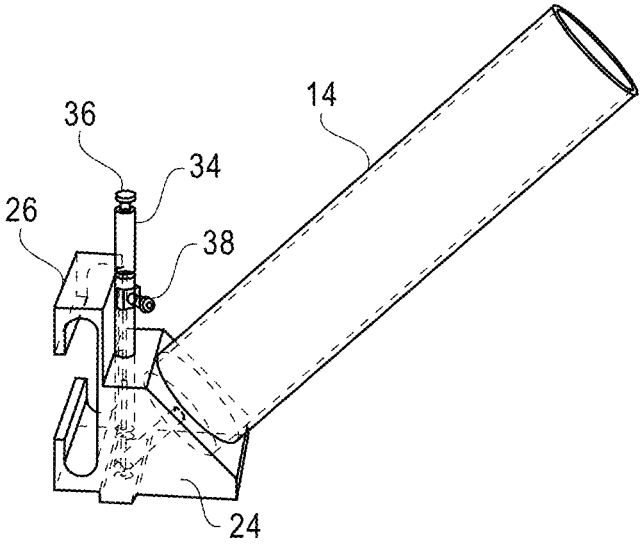
FIGS. 2A and 2B depict details modular reservoirs of a dispenser unit for the multi-material dispensing system shown in FIG. 1, with FIG. 2A depicting a side view of a reservoir and FIG. 2B depicting a cutaway view thereof.
Figure 2B:
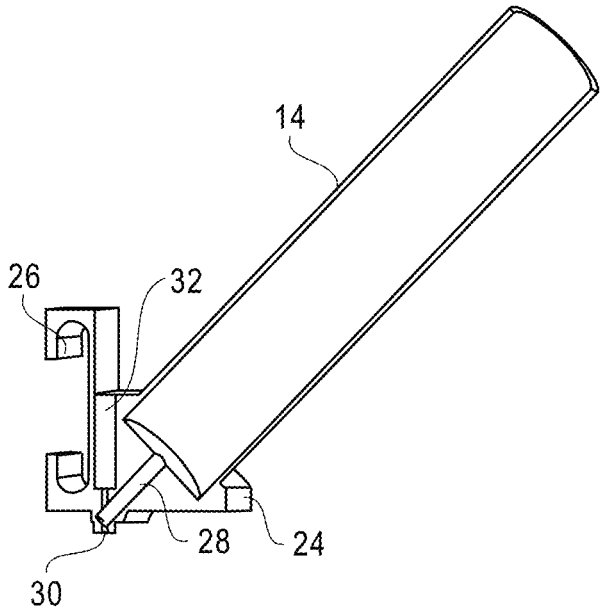
Figure 6:
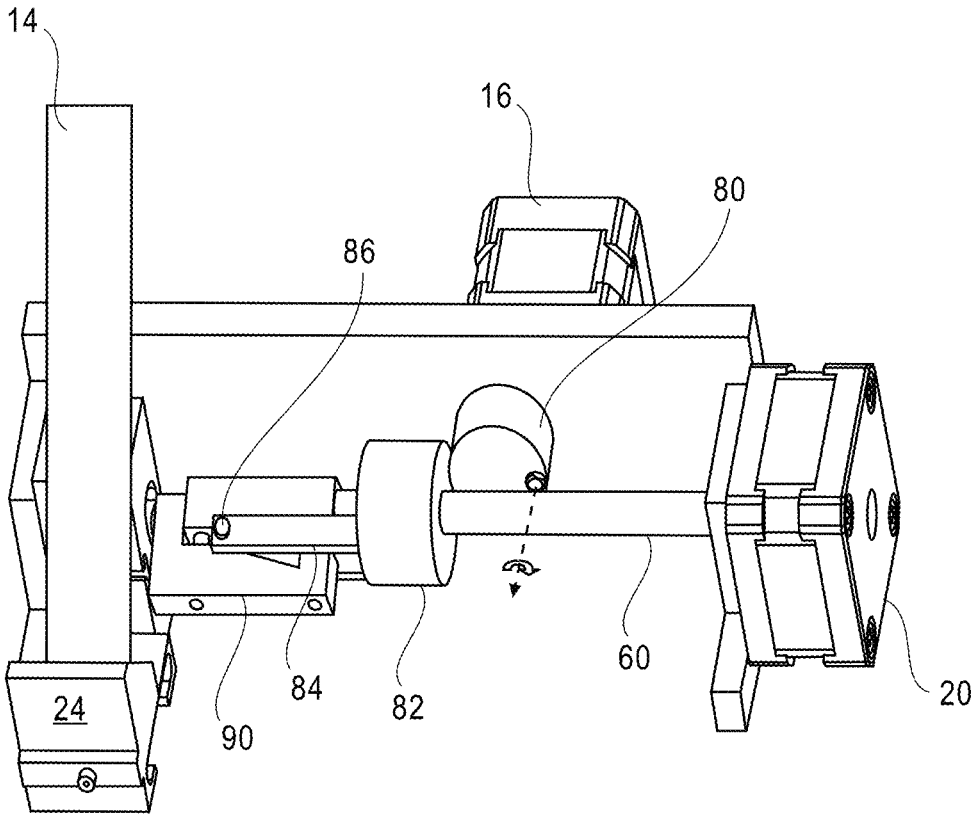
FIG. 6 illustrates motor 16 rotation of a piston stroke cam by a motor, which rotation, in turn, displaces the cam along the rotating shaft.

Dispensing system 10 consists primarily of five sections: a dispenser unit 12 with one or more reservoirs 14, pistons 34 that dispense the fluids, an actuator (or motor) 18 that allows the system to switch between materials to be dispensed, an actuator 20 that moves the pistons to dispense material, and an actuator to change the length of the piston stroke (not shown in this view—see element 16 in FIG. 6). With further reference to FIGS. 2A and 2B, the dispenser unit 12 includes one or more modular reservoirs 14. In FIG. 1, four reservoirs 14 are shown, however, this is merely for illustration. In various embodiments of the invention, one, two, three, four, or more reservoirs may be present. FIG. 2A shows a side view of a single reservoir 14 mounted in a bracket 24 of the dispenser unit. Bracket 24 may include rail mount 26, which can be secured over rails 28 when the dispenser unit is attached to the other components of the dispenser system 10.

FIG. 2B is a cutaway view of a reservoir 14 and bracket 24. The reservoirs are hollow, to accommodate a syringe 40 (see FIG. 2D) and include an elongated nipple 28. The reservoir nipple 28 provides a fluid path for liquid material from a syringe supported in a reservoir 14 towards a nozzle 30. At the top of each nipple 28 near its endpoint is a hole 31 (see FIG. 3B) to accommodate piston shaft 48 of piston 34. A corresponding hole 33 (see FIG. 3B) at the bottom of each nipple 28 is provided for the piston shaft to expel liquid droplets 50 from the reservoir nipple.

Figure 2C:
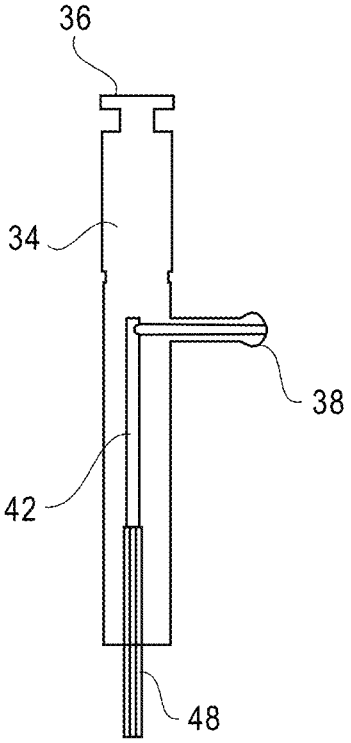
FIG. 2C shows a cutaway view of a piston for use with modular reservoirs such as those depicted in FIGS. 2A and 2B.
Figure 2D:
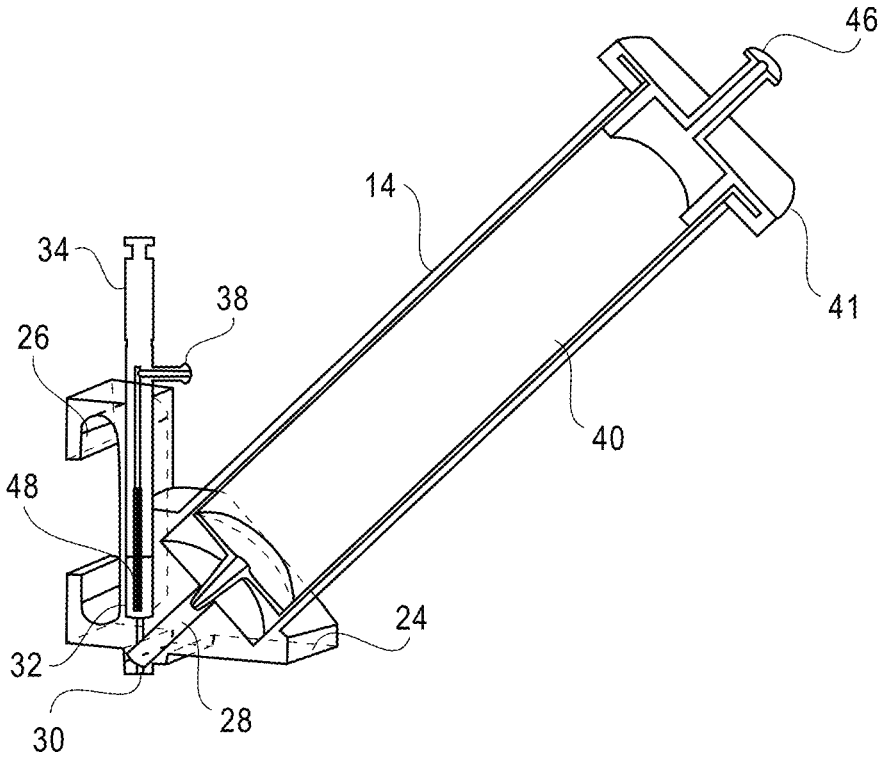
FIG. 2D shows a view of a modular reservoir accommodating a syringe and fitted with a cap 41; the modular reservoir is assembled in a bracket along with a piston positioned therein so as to prevent the release of liquid material from a nipple of the reservoir.
Figure 3A:
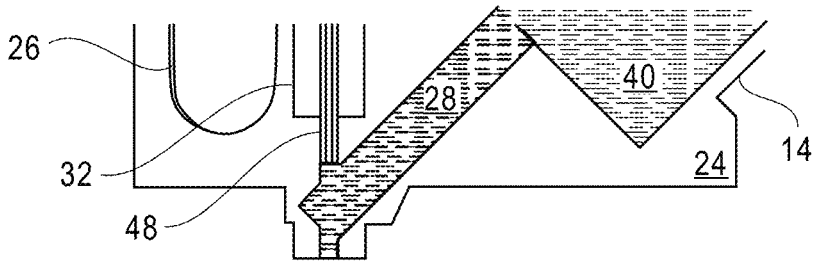
FIGS. 3A-3D illustrate the dispensing of a droplet of liquid material from a syringe positioned within a modular reservoir.
Figure 3B:
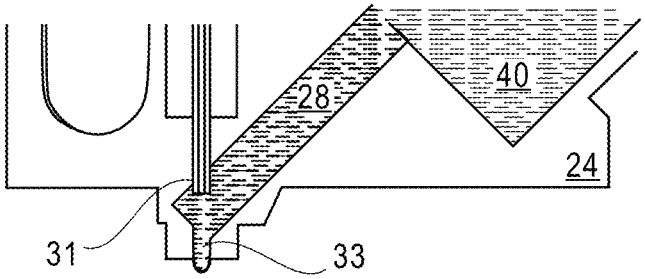
Figure 3C:
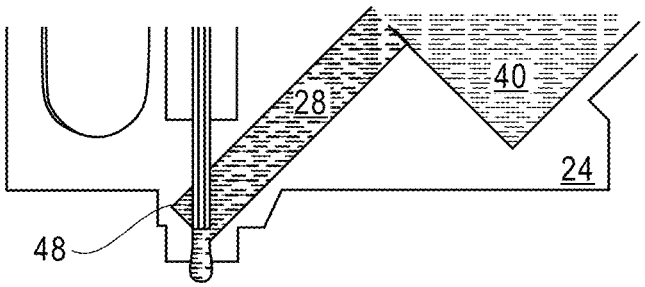
Figure 3D:
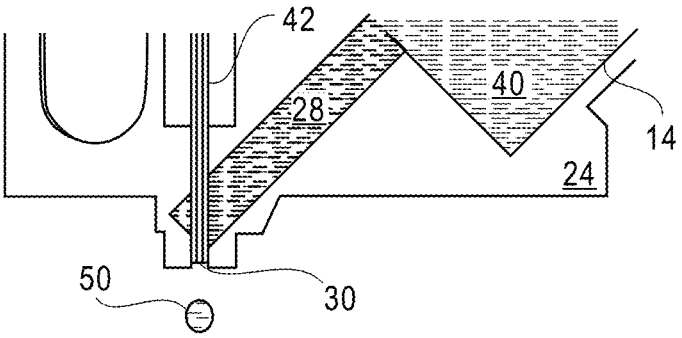
Figure 4A:
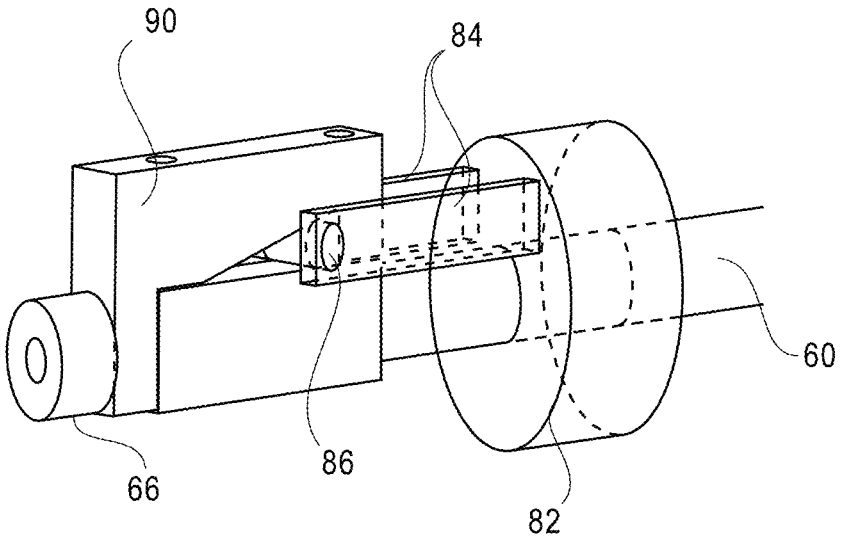
FIGS. 4A and 4B illustrate portions of the multi-material dispensing system of FIG. 1 for actuation of a piston to allow dispensing of a droplet of liquid material from a syringe positioned within a modular reservoir by way of a motor and rotating shaft.
Figure 4B:
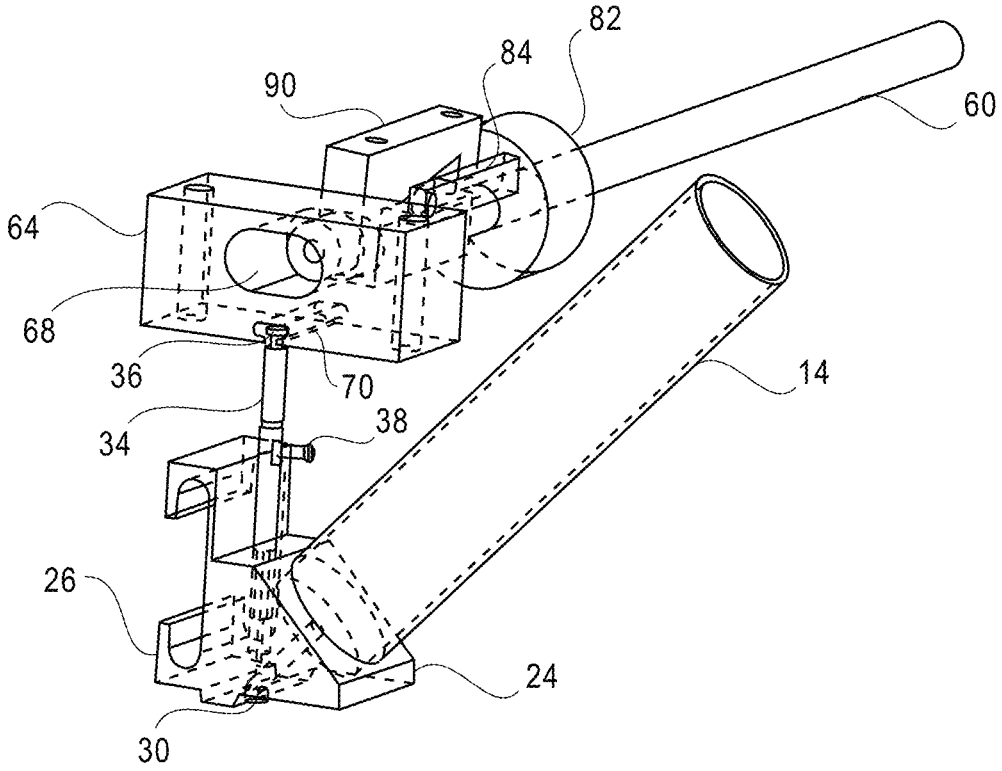
Figure 5A:
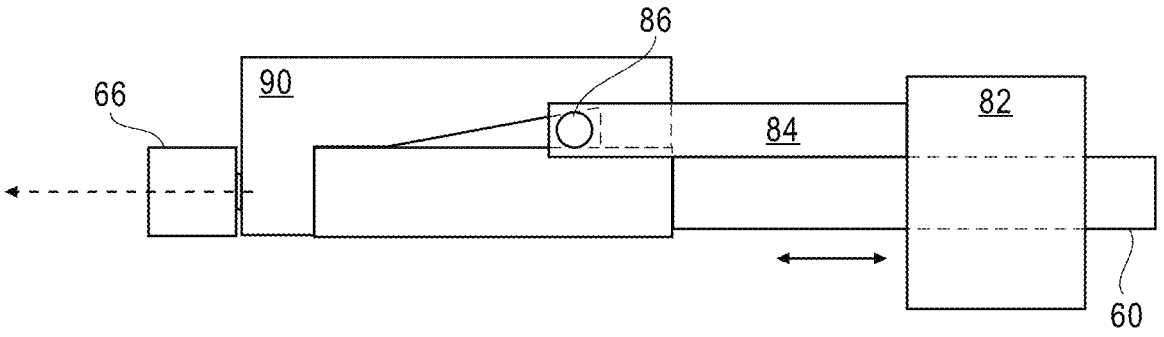
FIGS. 5A-5C illustrate how one end of the shaft shown in FIG. 4 is offset from is axis of rotation, forcing a piston nib capture unit to be displaced vertically, drawing the piston shaft up, as the shaft rotates.
Figure 5B:
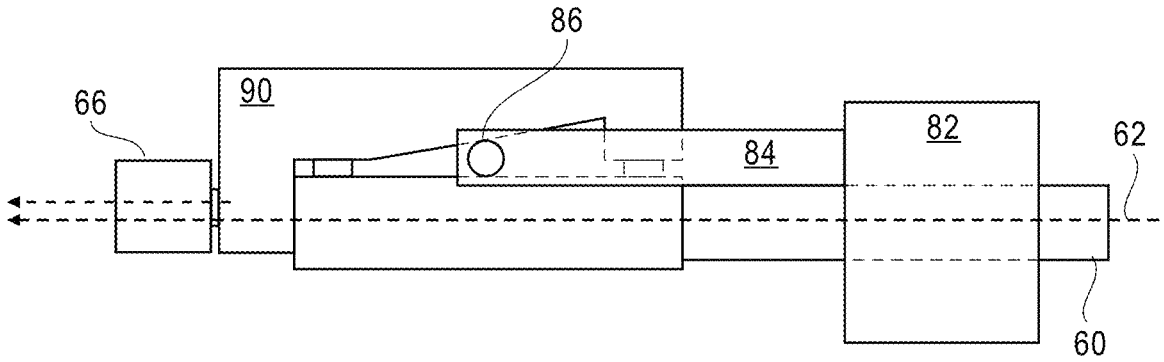
Figure 5C:
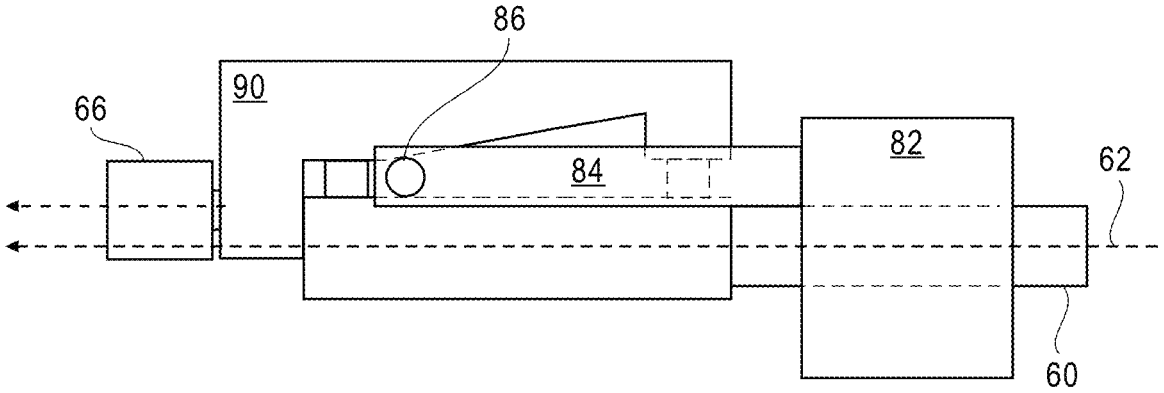

Above nozzle 30 is a piston recess 32, within which a piston 34 is positioned (see FIGS. 2A and 2D). As will be described below, actuation of piston 34 will control the dispensing of a droplet 50 (see FIG. 3D) of liquid material from the reservoir nipple 28. As shown in FIGS. 2A and 2C, piston 34 includes a nib 36 at the top, and an air nipple 38 positioned along its longitudinal length. A hollow shaft 42 is in fluid communication with the air nipple 38 and it extends through the piston shaft 48 so that, if desired and/or needed, a small amount of pressurized air or other gas can be injected through the hollow shaft 42 to expel a droplet of liquid material via nozzle 30.

When assembled, as shown in FIG. 2D, the modular reservoir 14 accommodates a syringe 40 and has a cap 41. Syringe 40 includes a plunger 46 and contains the liquid material to be dispensed. Piston 34 is positioned within recess 32 in bracket 24 and the piston shaft 48 is extended to prevent the release of liquid material from the reservoir nipple.

As shown in FIGS. 3A-3D, to dispense a droplet of liquid material when syringe 40 is in position within reservoir 14, piston shaft 48 is retracted to a position outside of the reservoir nipple 28 so that liquid enters the reservoir nozzle 28. As the piston shaft 48 is then extended vertically downward, along the longitudinal axis of the piston 34 (FIGS. 3B-3C), a droplet of precise volume is formed at nozzle 30 of reservoir 14. Ultimately, when the piston shaft 48 has been fully extended (FIG. 3D), the droplet 50 is released.

In some cases, it may be necessary or desirable to apply a small amount of pressurized air via air nipple 38 and hollow shaft 42 to cause the droplet 50 to separate; for example, when the liquid material being dispensed is relatively viscous and/or when the diameter of the nozzle is relatively small. After a droplet 50 has been dispensed, the piston shaft 48 is returned to its starting position (FIG. 3A), allowing the reservoir nipple 28 to refill so that a next droplet can be formed and dispensed. Alternatively, fluid droplets can be dispensed by applying pressure to plunger 46 of the syringe (FIG. 2D) when the piston shaft 48 is in its retracted position.

Figure 9C:
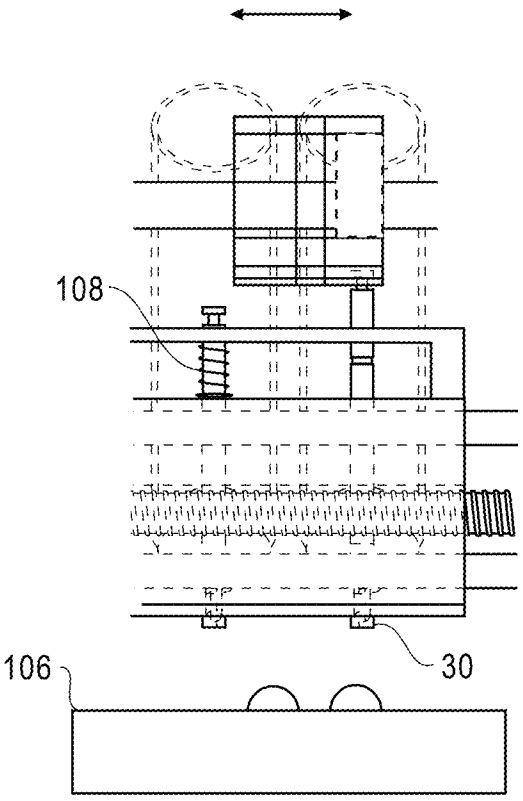
FIGS. 9A-9C show how rotation of the lead screw allows for precision positioning of a dispensed droplet.
Figure 9B:
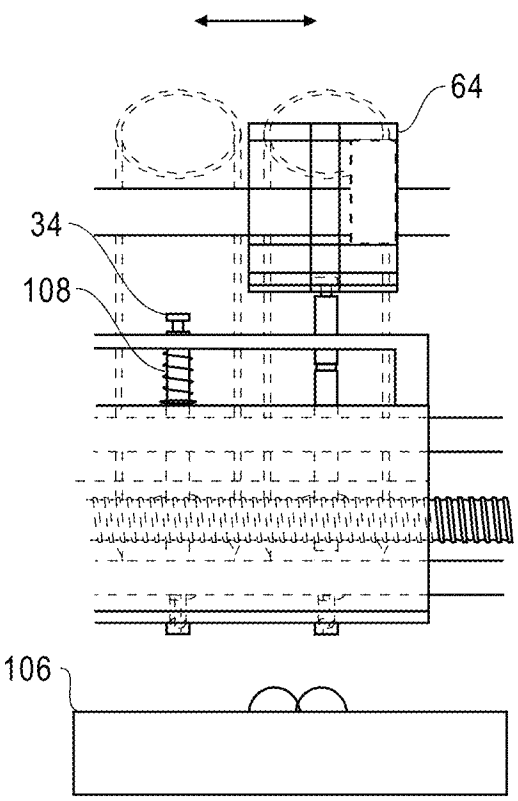
Figure 9A:
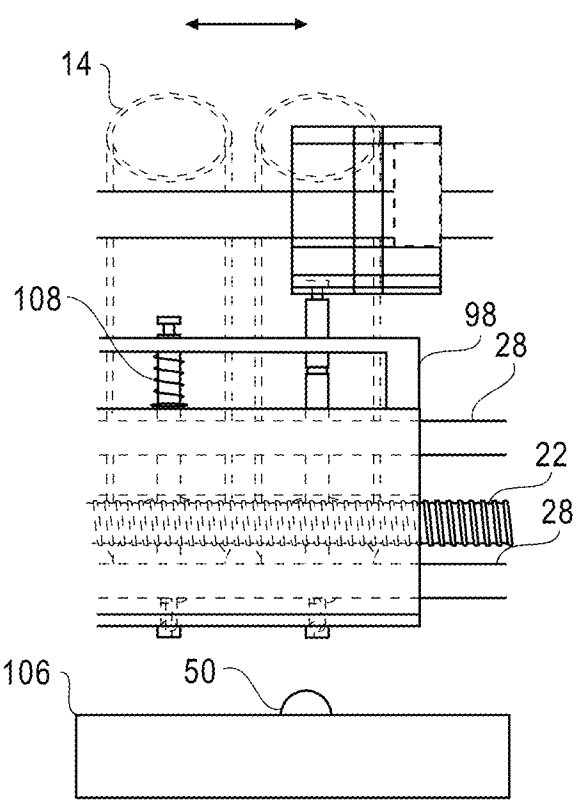

The piston 34 thus serves two functions. When pressure is applied to the reservoir 14 (that is, to the liquid in the syringe 40 within a reservoir 14), the piston 34 serves as a valve, controlling droplet deposition frequency and droplet size. If a low pressure is applied to the reservoir (i.e., a pressure less than that required to expel a droplet of liquid from the reservoir nipple, the piston 34 can be used to force the fluid through the nozzle 30. The hollow shaft 42 serves as a channel inside the piston allowing space for a gas (or other fluid) which can be pressurized in synchronization with the movement of the piston shaft to cause droplets to separate from the nozzle at the end of the piston. The pistons are spring-loaded (see element 108 in FIGS. 9A-9C) to ensure that they return to a closed position (FIG. 3D) when the reservoir is not in use.

Actuation of respective ones of pistons 34 is achieved by way of motor 20 rotating a shaft 60. With reference to FIGS. 1, 4A-4B, and 5A-5C, the end of the shaft 60 is offset from the axis of rotation 62, forcing a piston nib capture unit 64 to be displaced vertically, that is, parallel to the axis of the piston shaft, as the shaft rotates. The piston nib capture unit 64 includes a slotted recess 70, within which piston nib 36 is positioned (see FIG. 7B). Thus, as the piston nib capture unit moves vertically, the piston shaft 48, which is mechanically coupled to the nib 36 within the piston 34, moves vertically (i.e., along its longitudinal axis) as well.

More specifically, the movement of the piston nib capture unit 64 is affected by the rotation of a piston displacement cam 66 positioned at the end of shaft 60. The oval-shaped piston displacement cam 66 is positioned within a cam recess 68 of the piston nib capture unit 64. As shown in FIG. 1, the piston nib capture unit itself is supported in a piston capture block 68, so that it can translate vertically (i.e., parallel to the longitudinal axis of piston 34). When motor 20 rotates shaft 60, the piston displacement cam 66 rotates within an oval-shaped cam recess 68 of the piston nib capture unit 64. The piston nib capture unit 64 containing the cam recess 68 is fixed so as to remain stationary along an axis orthogonal to the longitudinal axis of the piston. Consequently, when the piston displacement cam 66 rotates with shaft 60, the piston nib capture unit 64 is translated vertically (i.e., in the direction defined by the longitudinal axis of piston 34). Because the piston nib 36 is secured within the slotted recess 70, the piston shaft 48, which is connected to the nib 36, is also translated vertically (i.e., along its longitudinal axis). Thus, the piston 34 can be actuated to control the deposition of liquid droplets.

Changing the length of the piston stroke is achieved by changing the offset distance of the end of shaft 60 from its axis of rotation. As shown in FIG. 6, motor 16 rotates a piston stroke cam 80, which in turn displaces cam 82 along the shaft 60. Cam 82 is linked by brackets 84 to a pin 86, which, as it is displaced by cam 82 moving along shaft 60, presses on a spring-loaded wedge 90. Wedge 90 is connected to piston displacement cam 66 so that as the wedge is forced open by the movement of pin 86, the center of rotation of the piston displacement cam 66 is moved radially away from the axis of rotation of shaft 60 (see FIGS. 5A-5C).

Figure 7A:
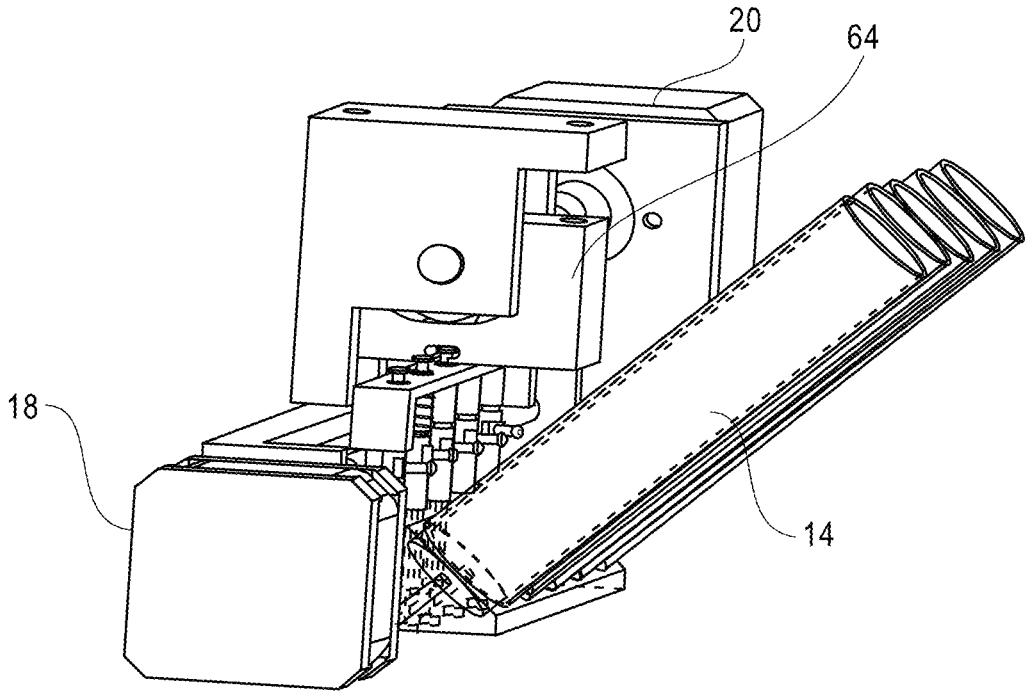
FIGS. 7A and 7B provide views of the dispenser unit that illustrate how individual pistons are organized therein and how the piston nibs of which are captured by a nib capture unit.
Figure 7B:
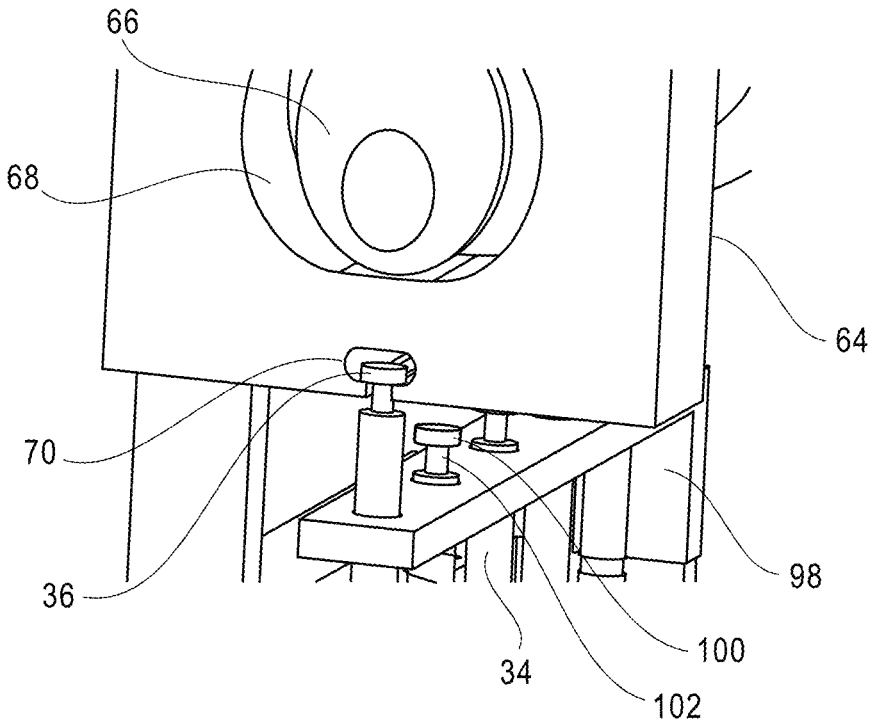

The system can switch rapidly between dispensation of various materials by way of motor 18 driving a lead screw 22 which moves the dispenser unit 12 while the piston actuator 20 remains stationary (see FIGS. 7A-7B and 8A-8C). As shown in FIGS. 7A and 7B, individual pistons 34 are organized within dispenser unit 12 and secured in place by a piston retaining bracket 98. By maintaining the dispenser unit 12 stationary, individual pistons 34 can be engaged by the piston nib capture unit 64 by positioning that unit so that the nib 36 of the desired piston 34 is located within the slotted recess 70 of the piston nib capture unit 68. The slotted recess is shaped to conform to the dimensions of the piston nibs, which are characterized by a wide head 100 and narrow neck 102. When each of the pistons 34 of dispenser unit 12 is in its initial position (FIG. 3D), with its respective piston shaft 48 extended to prevent the flow of liquid from respective nozzles 30, heads 100 of the respective nibs 36 of the pistons will pass through slotted recess 70 of the piston nib capture unit 64 as the dispenser unit is moved. When the dispenser unit is located such that the nib 36 of a desired piston (corresponding to a desired liquid to be dispensed) is located within the slotted recess 70, the motion of the displacement unit is stopped so that when the piston nib capture unit is engaged by the piston displacement cam 66, it moves vertically, pulling on the piston nib 36 and retracting the respective piston shaft 48 (see FIG. 3A).

Figure 8A:
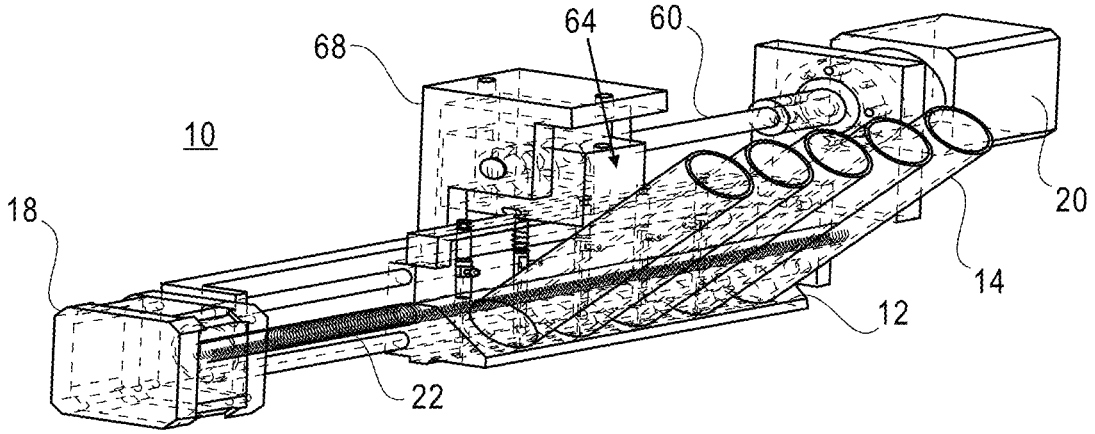
FIGS. 8A-8C illustrate repositioning of the dispenser unit along a lead screw of the multi-material dispensing system by means of a motor rotating the lead screw clockwise or counter-clockwise.
Figure 8B:
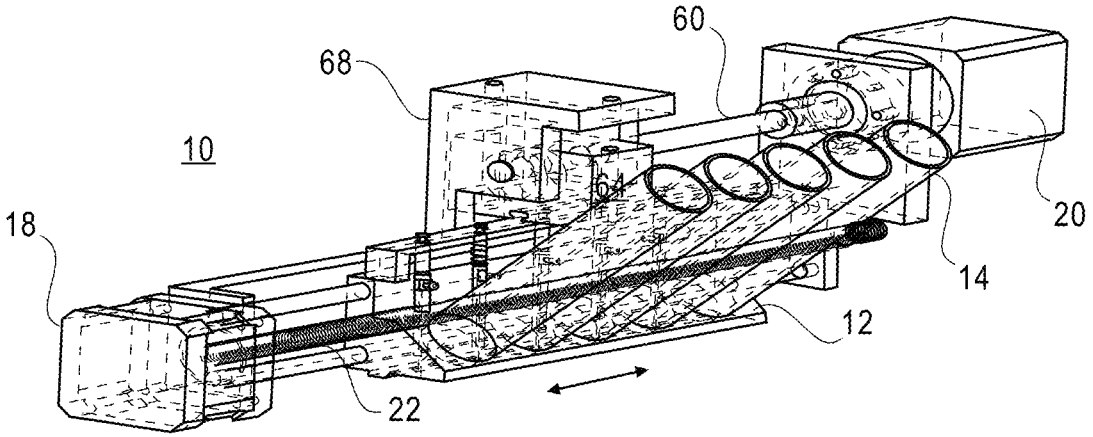
Figure 8C:
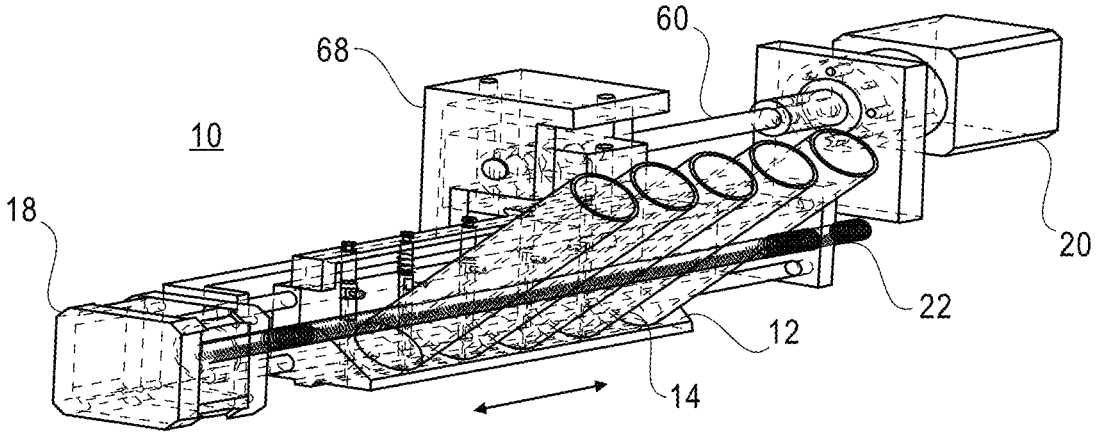

As illustrated in FIGS. 8A-8C, the dispenser unit 12 is repositioned by motor 18 rotating lead screw 22 clockwise or counter-clockwise. Dispenser unit 12 is supported on rails 28 and includes a threaded hole that receives lead screw 22. When lead screw 22 is rotated, its threaded circumference engages the threads in the threaded hole of dispenser unit 12, causing the dispenser unit to be translated laterally, with the piston nibs passing through the slotted recess of the piston nib capture unit, as discussed above. This allows the positioning of a desired piston, i.e., a desired liquid for dispensing, over a designated dispensing position of an article or film. This arrangement allows rapid switching of liquids for dispensing by way of a single mechanism that can deposit fluid from any of the reservoirs. Rotation of the lead screw allows for precision positioning of the droplet, see FIGS. 9A-9C, as the point of dispensing moves with respect to the stage 106.

Figure 10:
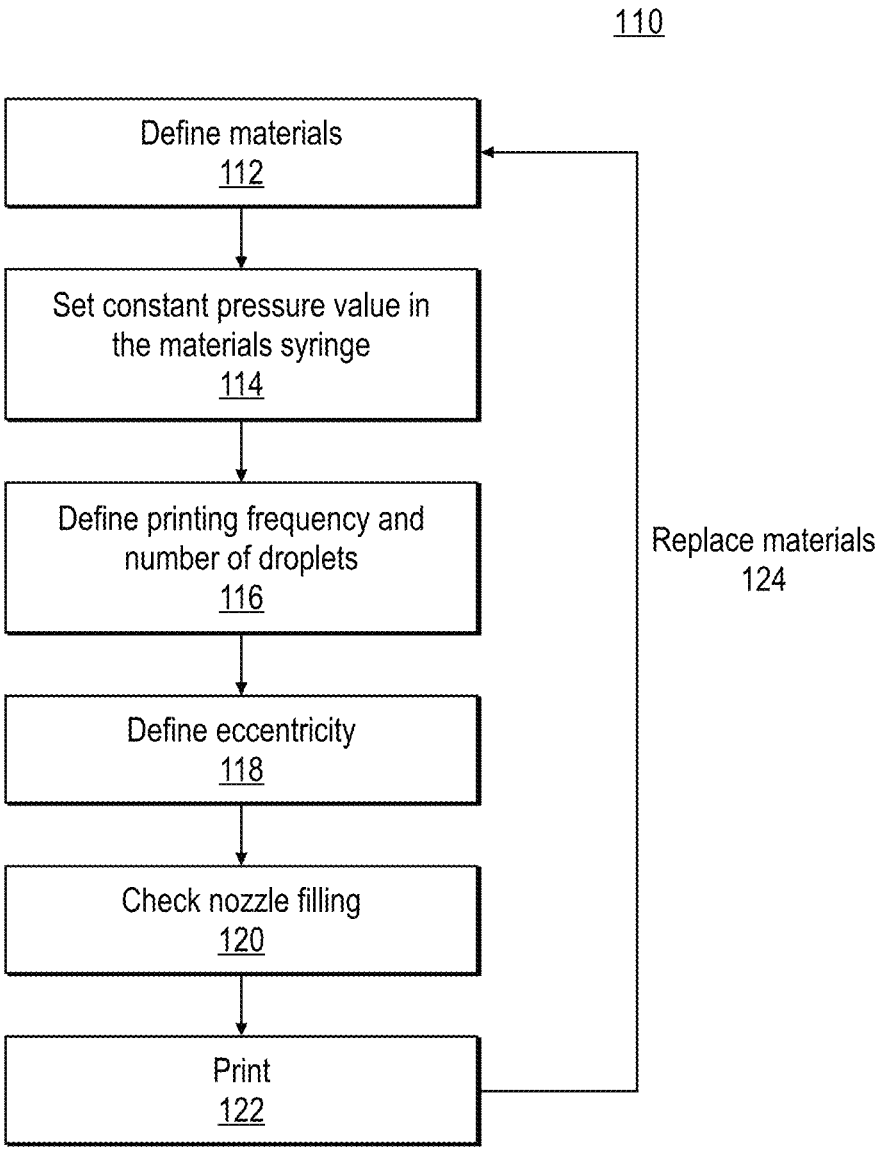
FIG. 10 illustrates a process for dispensing materials in accordance with an embodiment of the present invention.

Referring now to FIG. 10, a process 110 for dispensing materials is illustrated. At step 112, the materials to be dispensed are defined. This involves filling the syringes 40 that will be included in the plurality of reservoirs 14 of the dispenser unit 12 with the liquid materials of interest. The syringes 40 are then placed in their respective reservoirs. Next, at step 114, the pressures of the syringes are set (e.g., by adjusting the position of plungers 46. This ensures that liquid droplets will be dispensed when the pistons are activated. Then, at step 116, the print frequency, droplet patterns, numbers of droplets, etc. are set. Although not shown in the diagrams, this involves programming a control unit that is connected to the various motors 16, 18, 20, with the desired print pattern. The control unit includes, preferably, a microprocessor and a memory coupled thereto, which memory stores the control program for this dispensing unit 10.

In one embodiment, the microprocessor and memory of the control unit are communicatively coupled by a bus or other communication mechanism for communicating information. In addition to a program store memory, the control unit may include a dynamic memory, such as a random-access memory (RAM) or other dynamic storage device, coupled to the bus for storing information and instructions to be executed by the microprocessor. This dynamic memory also may be used for storing temporary variables or other intermediate information during execution of instructions to be executed by the microprocessor. The program memory may be a read only memory (ROM) or other static storage device coupled to the bus for storing the program instructions. Alternatively, or in addition, a storage device, such as a magnetic disk or optical disk, may be provided and coupled to the bus for storing information and instructions. The control unit may also include a display, for displaying information to a user. Along with various input devices, including an alphanumeric keyboard and a cursor control device, such as a mouse and/or trackpad, this forms part of a user interface for the dispensing system 10. Further, one or more communication interfaces may be included to provide two-way data communication to and from the dispensing unit. For example, network interfaces that include wired and/or wireless modems may be used to provide such communications.

In addition to defining the print frequency, etc., the offset or eccentricity of the piston displacement cam 66 is also defined 118. This has the effect of defining the piston stroke length, as discussed above. A check can be made to ensure the nozzles are properly dispensing liquid 120, and the printing operations run 122. As needed, liquid materials are replaced 124 during the printing process.

Figure 11:
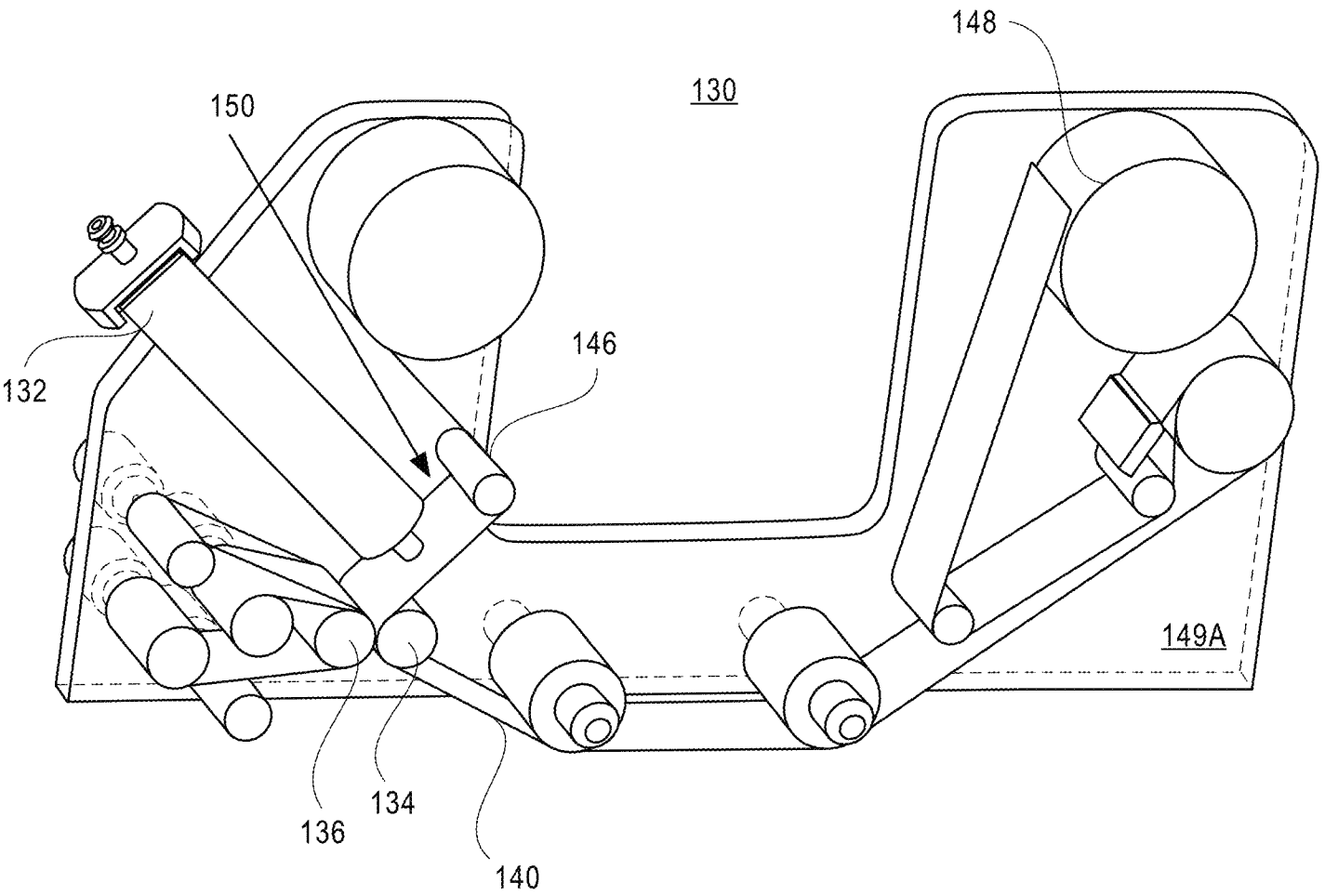
FIG. 11 illustrates one example of a coating apparatus for application of a coating of a rheological material on a flexible film by way of an applicator such as a modular reservoir having a syringe included therein, as shown in FIG. 2D, in accordance with embodiments of the present invention.

Referring now to FIG. 11, one application of material coating is the application of a thin and precise layer of rheological material on a flexible film using a coating apparatus 130. In this illustration, the coating apparatus is shown with an applicator 132 which may resemble a reservoir having a syringe included therein, similar to that discussed above. In other embodiments, described below in connection with FIGS. 13 and 14, the coating apparatus 130 may include a complete material dispensing arrangement 10 as described above.

In coating apparatus 130, two rollers 134, 136, separated by a gap 138 define the thickness of the layer of material applied to a film 140. As shown in detail in FIG. 12, the gap width is defined by two tense microwires 142A, 142B, which are maintained within the gap 138. The coater roller 136 is covered with another film 144 to guarantee high surface quality. When changing between materials for coating, the coater roll film 144 (along with the microwires 142A, 142B) may be advanced to prevent contamination. That is, a contact area of the film that covers the coater roller 136 may be adjusted relative to the gap (across which the coater roller film opposes the film to which the rheological material is applied), e.g., when switching to a different rheological material. Similarly, if the coater roll film 144 becomes eroded or otherwise degraded, it may be advanced or replaced.

Figure 12:
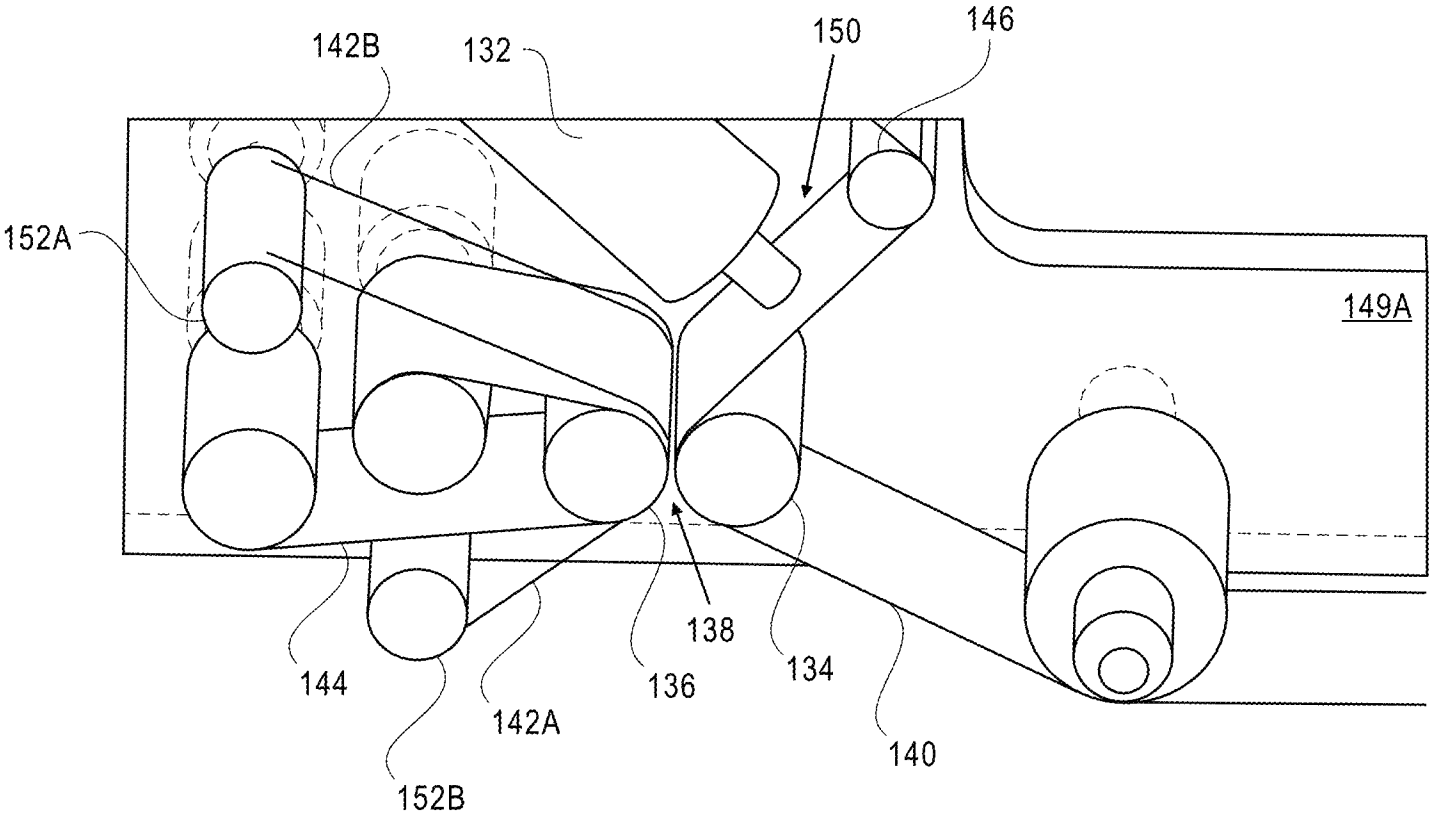
FIG. 12 shows details of a gap within which a flexible film travels in the coating apparatus shown in FIG. 11, with a gap width defined by two tense microwires maintained within the gap.

The film being coated is advanced through a coating region under the applicator 132 using a series of rollers under the control of one or more motors (not shown). As illustrated, the film is wound off an initial spool 146, through the coating region 150 under applicator 132, and onto a take up spool 148. The precise configuration of the path through which the film 140 travels will depend on the nature of the material being applied and of the film, and is not critical to the present invention, except that in the coating region 150, the thickness of the layer of material being applied is determined by the gap width, which, in turn, is dependent upon the thickness of microwires 142A, 142B. As shown in FIG. 12, the microwires are suspended through the gap 138 and supported on rollers or pins 152A, 152B. Rollers or pins 152A, 152B, rollers 134, 136, initial spool 146, and take up spool 148 may be mounted on frame 149A.

As is known in the art, contact coating of a thin film using two rollers presents challenges in achieving high surface quality and avoiding abrasive wear. The proposed system offers unique solutions to these issues at a low cost of operation. For example, the use of the microwires allows very accurate control of coating thickness (by defining the gap width) at low cost. Further, because the wires as well as the film 144 can be easily rotated or exchanged when a change is made between coating materials, cross-contamination of different materials is easily avoided. Further, the use of the microwires, to maintain the gap width, allows for coating with abrasive materials with minimal system wear. Because the rollers 134, 136 are not in direct contact with the abrasive materials, they do not suffer wear as easily as conventional systems. Indeed, the use of film 144 covering coater roller 136 relaxes roughness requirements for the roller.

In one instance, adjusting the width of the gap may be adjusted during dispensing of the rheological material by exchanging the microwires within the gap for a different pair (or other number) thereof of different thickness. In other instances, dispensing of the rheological material may be paused while exchanging the microwires for ones of different thickness. Exchanging the microwires may be accompanied by rotating or otherwise moving the contact surface of the coater roll film 144.

Figure 13:
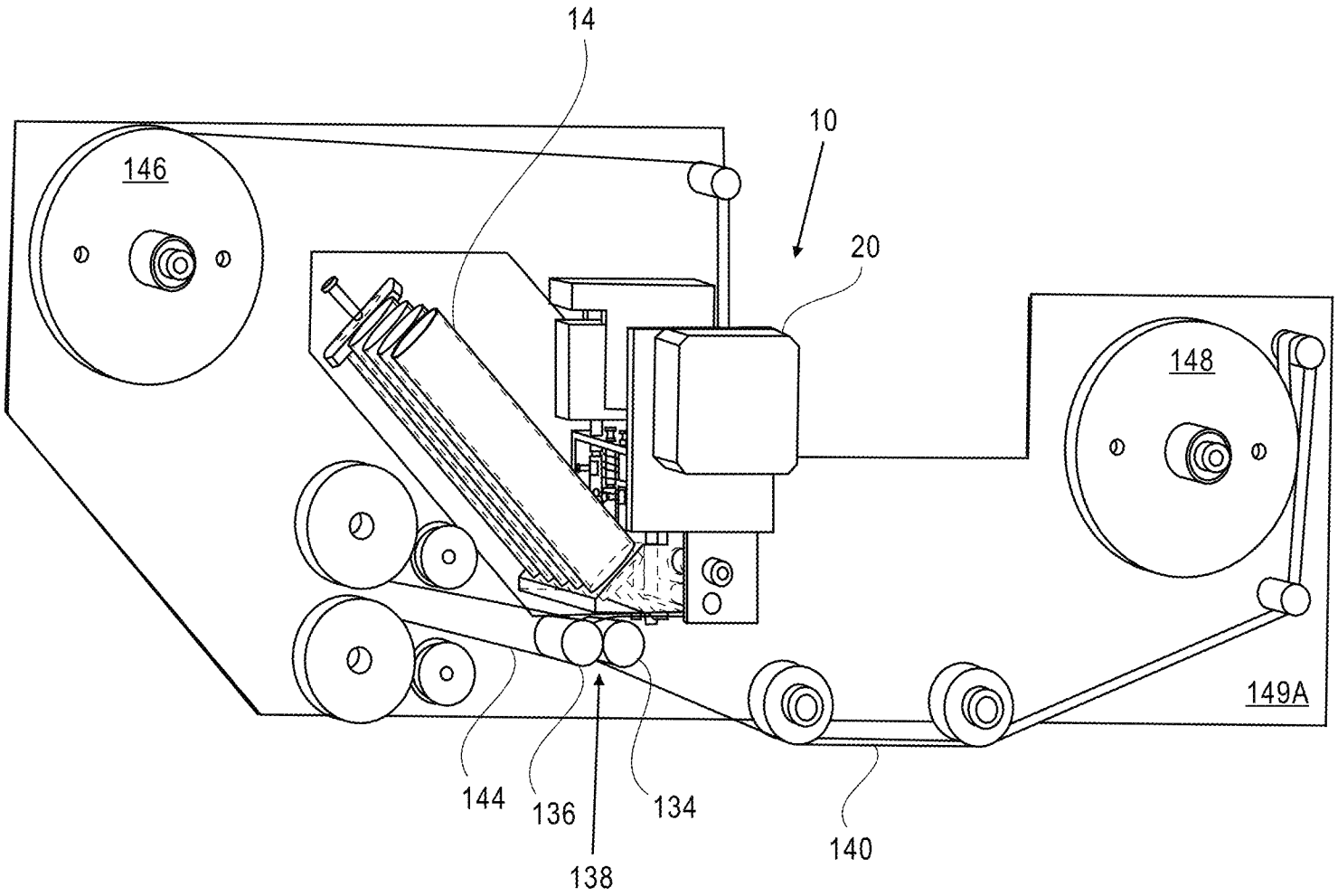
FIGS. 13 and 14 illustrate the use of the multi material dispensing system shown in FIG. 1 with the coating system illustrated in FIG. 11.
Figure 14:
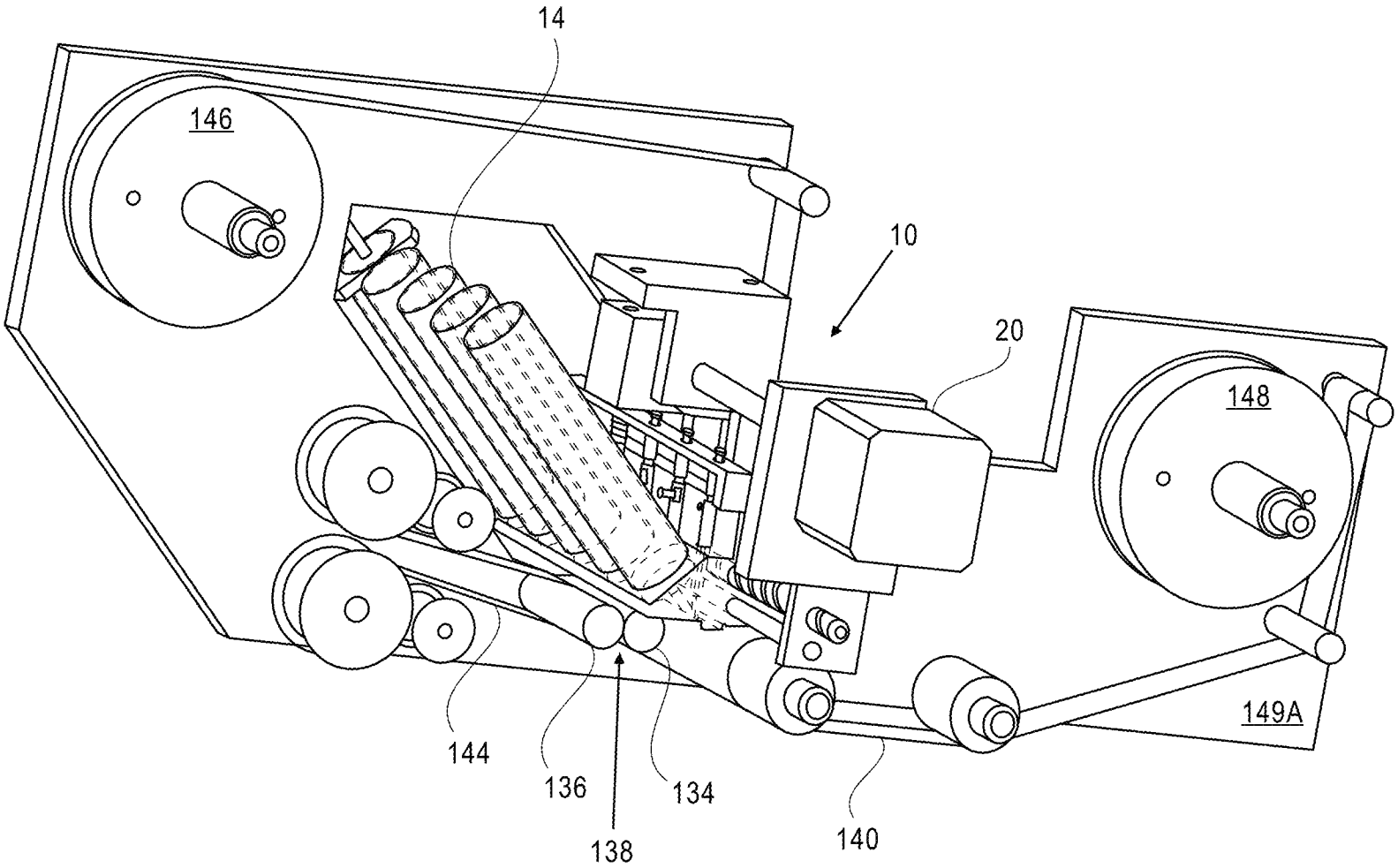

Referring now to FIGS. 13 and 14, the use of the multi material dispensing system 10 with the coating system 130 is illustrated. In these examples, the applicator 132 has been replaced with the multi material dispensing system 10 and the film path adjusted accordingly to accommodate this unit. The film being coated still passes through a coating region 150 where the liquid material(s) are applied to the film, and then through a gap 138, the thickness of which is defined by the suspended microwires. The gap width determines the thickness of the layer being applied. Using multi material dispensing system 10, the liquid materials being applied to film 140 can be quickly changed, as discussed above.

In such an arrangement, it may not be necessary to change the piston stroke length inasmuch as the thickness of the material layer is determined by the gap width 138. Hence, in the illustration the motor and other components for adjusting this dimension are not shown. In other embodiments, however, the piston stroke length can be controlled using the above-described mechanisms.

The present coating system solves some of the difficulties inherent in coating thin films with multiple materials. Fluid for coating is deposited on the film to be coated. The coating is spread into a coating of specified thickness by rollers 134, 136. Roller 134 on the side of the film being coated rotates freely, while roller 136 remains fixed during the coating process. Deposition of different materials is achieved by changing the materials in applicator 132, or by using the multi material dispensing system 10. To prevent contamination of the system when switching from one coating to another, roller 136 is covered with a thin film 144, which is advanced so as to ensure the next coating is applied in a clean environment. The use of this film 144 also relaxes tolerances on the roughness of roller 136, and enables the coating of corrosive materials, relying instead on the smoothness of the film to ensure even coating. This eliminates the need to use expensive rollers machined with high precision. The ability to advance this second film periodically also allows for effective deposition of abrasive materials. In current systems, the second roller experiences wear due to the abrasive nature of the coating materials. In the proposed system, the film is advanced before wear becomes significant, mitigating any loss in accuracy of coating thickness.

The use of microwires 142A, 142B positioned between the two rollers 134, 136 serves to define the gap between the two films 140, 144. During operation, a pair of motors or other actuators may be used to force rollers 134, 136 together at a specified and controlled force. This ensures a tight seal during the coating process, without the pressure from the wires causing damage to the films, and without need for expensive precise position control systems. Replacing the wires with those of different thickness, and adjusting the force holding the rollers together, adjusts the width of gap 138 and allows for coatings of different thicknesses.

Figure 15:
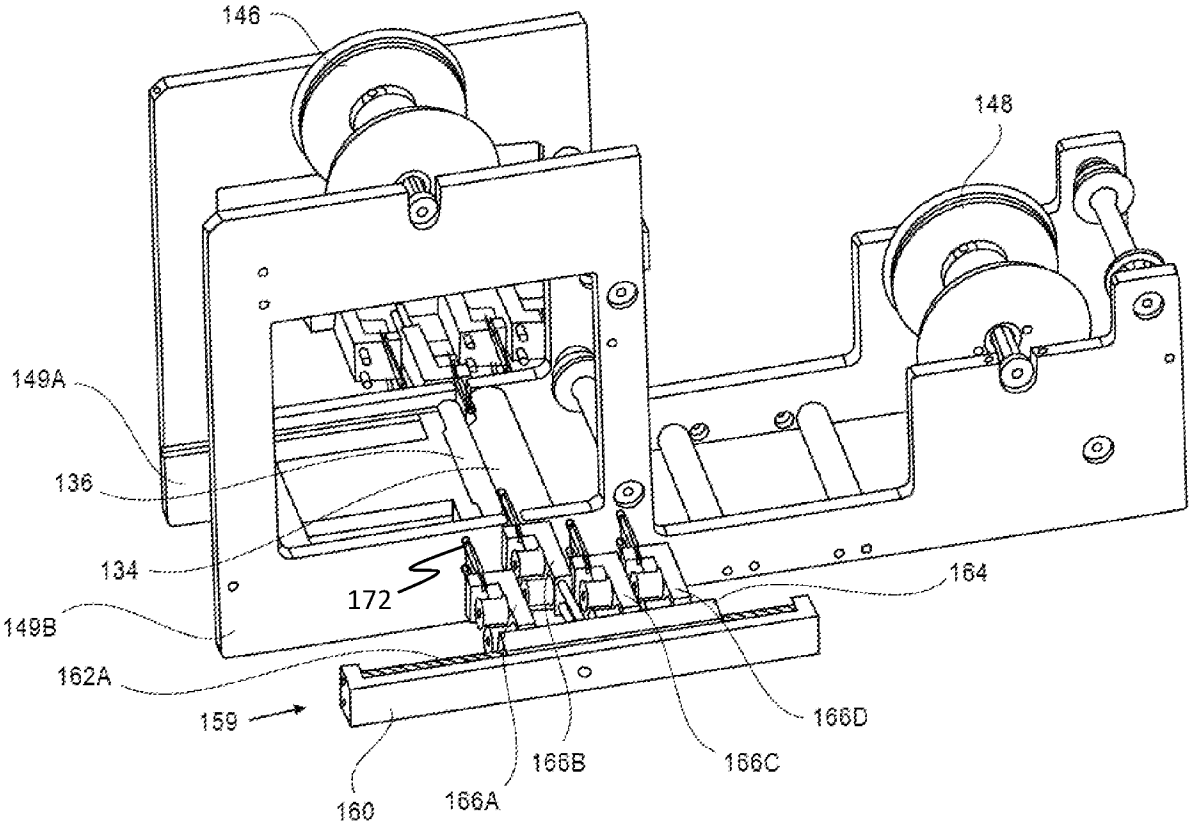
FIG. 15 depicts a perspective view of a coating system in which microwires of varying thicknesses may be used to define an adjustable gap width between rollers in accordance with an embodiment of the present invention.

FIG. 15 depicts a perspective view of a coating system in which microwires of varying thicknesses may be used to define the gap between rollers 134 and 136 (i.e., making the gap width adjustable). A plurality of microwire holders 166A, 166B, 166C and 166D may be mounted on rack 164. The number of microwire holders, in the depicted embodiment, is four, but this number may vary in other embodiments. Rack 164 may be secured to a track formed using one or more rails (first rail labeled as 162A, second rail not visible in FIG. 15). The rails may be secured to rail holder 160. By sliding rack 164 along the track, the microwire holder with a microwire having the desired thickness (i.e., the selected microwire holder) may be positioned adjacent to the gap between rollers 134 and 136. In the instant example, microwire holder 166B is the selected microwire holder. By displacing the selected microwire holder in a direction perpendicular to an extent of the track, the microwire with the desired thickness may be positioned between rollers 134 and 136.

In the embodiment of FIG. 15, frame 149B separates microwire sub-assembly 159 (including components 160, 162A, 164, 166A-D) from rollers 134 and 136, and a slot may be present in frame 149B to allow the microwire to pass through frame 149B and into the gap between rollers 134 and 136. A mirror image of microwire sub-assembly 159 may be present in back of frame 149A (partially obscured by frame 149A in the perspective view) to further define the gap between rollers 134 and 136.

If not already apparent, frame 149A depicted in FIG. 15 may correspond to frame 149A depicted in FIGS. 11-14. The shape of the frames in the various drawings may differ, but the function of the frames to support rollers 134, 136, initial spool 146, and take up spool 148 may be similar. Also, it is noted that various components of the coating system (film 140, liquid reservoirs 14, etc.) are not depicted in FIG. 15 for clarity of illustration, but it is understood that the various components described in FIGS. 1, 2A-2D, 3A-3D, 4A, 4B, 5A-5C, 6, 7A-7B, 8A-8C, 9A-9C and 11-14 may be present in the coating system of FIG. 15, even though they have not be depicted.

Figure 16:
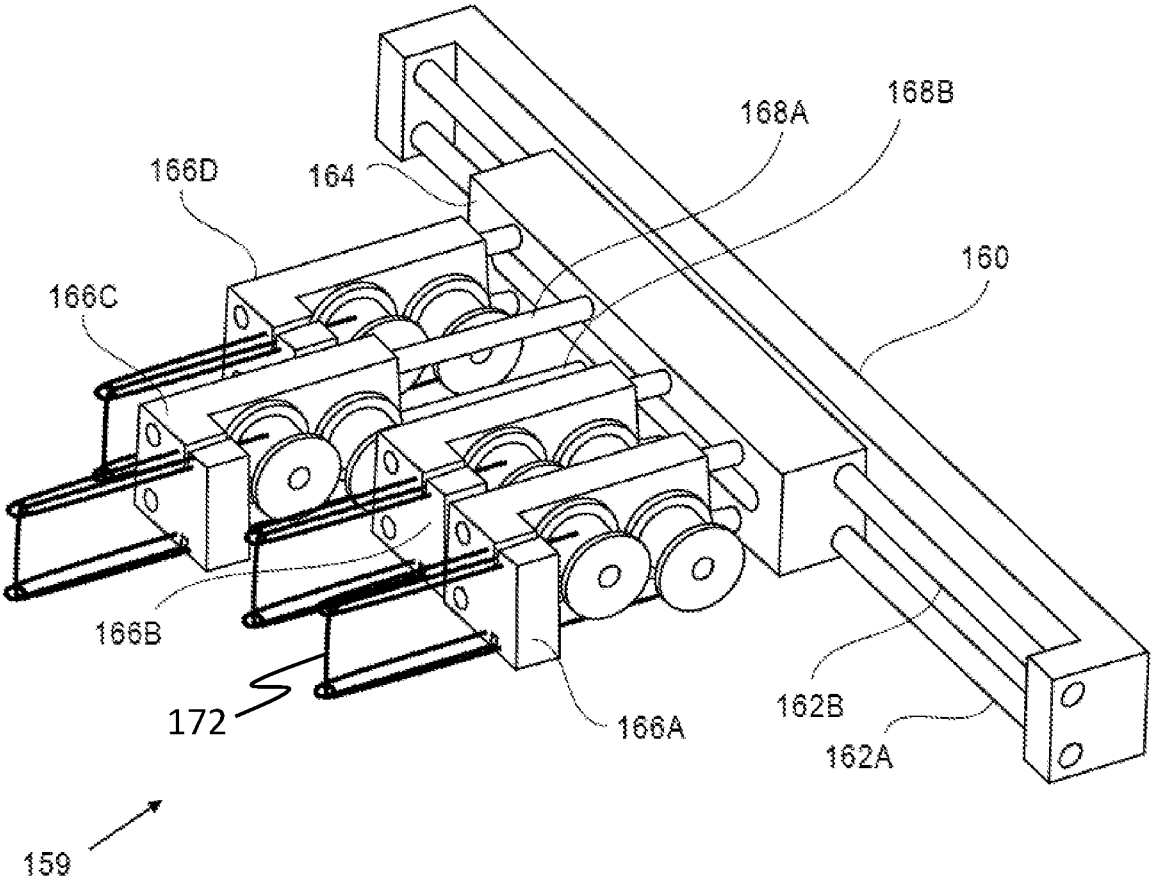
FIG. 16 depicts a perspective view of the microwire sub-assembly shown in FIG. 15 in more detail.

FIG. 16 depicts the perspective view of microwire sub-assembly 159 in more detail. As described above, microwire sub-assembly 159 may include one or more microwire holders 166A-D, which are mounted to rack 164. Rack 164 may be secured to a first track with one or more rails 162A, 162B, which in turn may be secured to rail holder 160. By sliding rack 164 along the first track (e.g., by means of a motor, not depicted), the plurality of microwire holders 166A-166D may be translated in a direction parallel to an extent of the first track. Each microwire holder may be displaced (e.g., by means of a motor, not depicted) along respective second tracks, formed by rails 168A, 168B, in a direction perpendicular to the extent of the first track. In the instant example, microwire holder 166C is disposed in an extended position, while microwire holders 166A, 166B and 166D are disposed in retracted positions.

Figure 17:
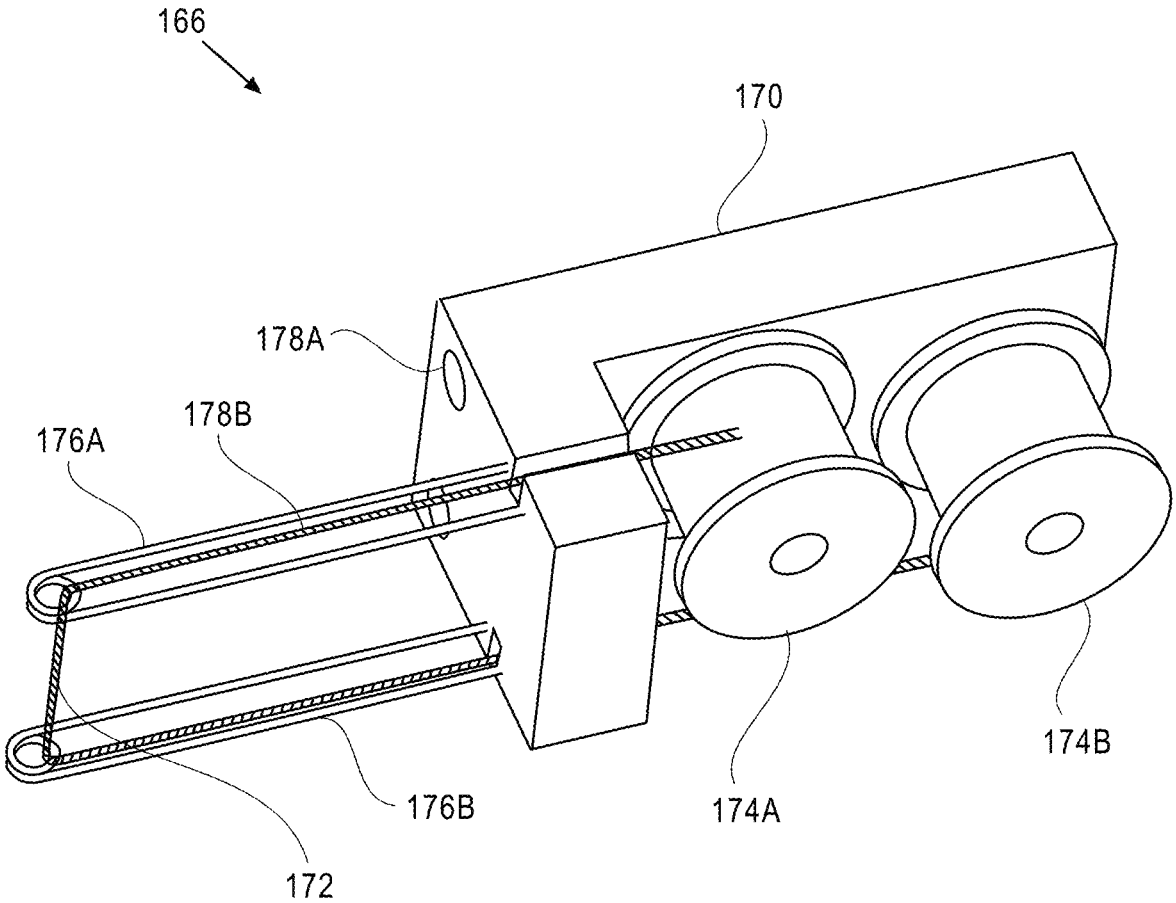
FIG. 17 depicts a perspective view of one of the microwire holders of the microwire sub-assembly shown in FIG. 15 in more detail.

FIG. 17 depicts the perspective view of one of the microwire holders in more detail. Microwire holder 166 may include holder frame 170 to which drums 174A, 174B and wire supports 176A, 176B are mounted. One end of microwire 172 may be secured to drum 174A and the other end of microwire 172 may be secured to drum 174B. A middle portion of microwire 172 may be supported by wire supports 176A, 176B. Rotation of drums 174A, 174B (e.g., in a clockwise, counter-clockwise direction) about respective axes of rotation may allow the tension of microwire 172 to be adjusted. In practice, microwire 172 is secured in a taut manner so that the section of microwire 172 between supports 176A and 176B has a linear form (i.e., resembles a 1-dimensional line). Also visible in the perspective view of FIG. 17 are end-portions of linear cavities 178A, 178B, through which rails 168A, 168B (depicted in FIGS. 16, 18) may extend, respectively.

Figure 18:
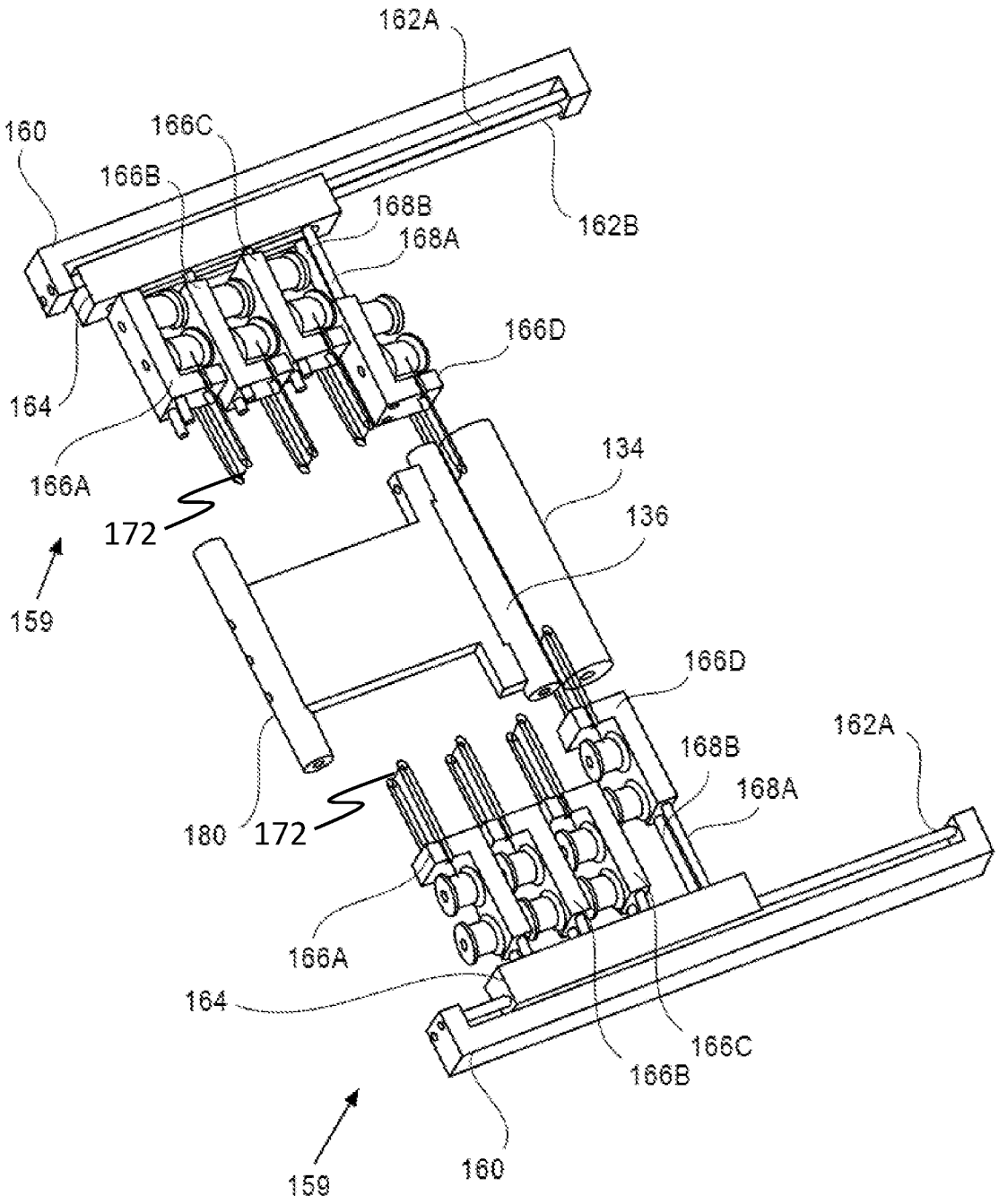
FIG. 18 depicts a perspective view of rollers of the coating system shown in FIG. 15 in which the gap therebetween is defined by two microwire sub-assembles in accordance with an embodiment of the present invention.

FIG. 18 depicts a perspective view of rollers 134, 136 in which the gap therebetween is defined by two microwire sub-assembles (each instance of the microwire sub-assembles is labeled as 159). In the operation of the microwire sub-assemblies, racks 160 may be linearly translated along rails 162A, 162B so as to position the selected microwire holders (i.e., holders with microwires having desired thickness) adjacent to rollers 134, 136 (in this example, microwire holders 166D). Next, the selected microwire holders may be linearly translated along rails 168A, 168B to position sections of the selected microwires immediately adjacent to the surface of roller 134. Finally, roller 136 may be positioned (using roller support 180) so that the surface of roller 136 touches the microwires that have been inserted into the gap between rollers 134, 136, thereby forming the gap between the rollers of the desired width. It is understood that such process may be repeated (when necessary) to configure the gap between rollers 134, 136 to have a different width. In turn, coatings of different thicknesses may be formed on film 140. For example, a coating process may begin with dispensing of a first rheological material while the coating apparatus has a first gap width defined by a first pair (or other number) of microwires suspended through the gap, and then the dispensing of the first rheological material may be suspended in favor of dispensing a second rheological material onto the surface of the film 140, adjusting the width of the gap by exchanging the first microwires for second microwires of different thickness than the first microwires through the gap.

In the embodiments illustrated in FIGS. 11-18, the microwires, e.g., 142A and 142B, were illustrated as being positioned between both the two rollers, 134 and 136, and between the two films, 140 and 144. Thus, the thickness of the microwires serves to define the gap 138. This is advantageous from the standpoint of offering very precise control over the width of the gap, however, the microwires may put pressure on one or both films 140 and 144, thereby causing abrasion to and/or defamations of one or both films. To address this issue, in some embodiments of the invention, the arrangement depicted in FIGS. 11-18 may be modified so that the width of film 140 (on which the layer of material is applied) is narrower than the spacing between the microwires 142A and 142B. In such an arrangement, the microwires 142A and 142B will contact the roller 134 (e.g., near its edges), but not the film 140. As a result, there is no pressure on film 140 due to the microwires, hence the risk of abrasion or deformation of film 140 is reduced. However, some control over the precision of gap 140 is lost inasmuch as the gap width is now dependent upon both the thickness of the microwires 142A and 142B and the thickness of film 144. Yet another modified arrangement has the width of film 140 and the width of film 144 both narrower than the spacing between the microwires 142A and 142B. In that arrangement, the microwires 142A and 142B contact rollers 134 and 136 (e.g., near their respective edges), but neither of film 140 or film 144. As a result, there is no pressure on either film 140 or film 144 due to the microwires, hence the risk of abrasion or deformation to both films 140 and 144 is reduced. However, some control over the precision of gap 140 is lost inasmuch as the gap width is now dependent upon both the thickness of the microwires 142A and 142B and the thickness of both films 140 and 144.

Figure 19B:
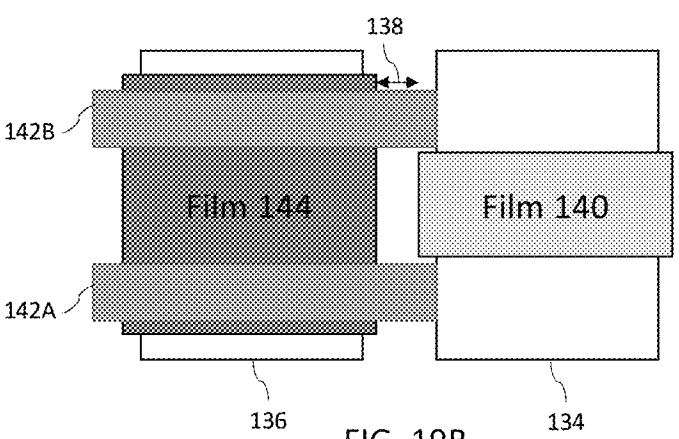
FIGS. 19A-19C illustrate different arrangements of the microwires with respect to a pair of rollers and associated films engaged therewith for the embodiments depicted in FIGS. 11-18.
Figure 19A:
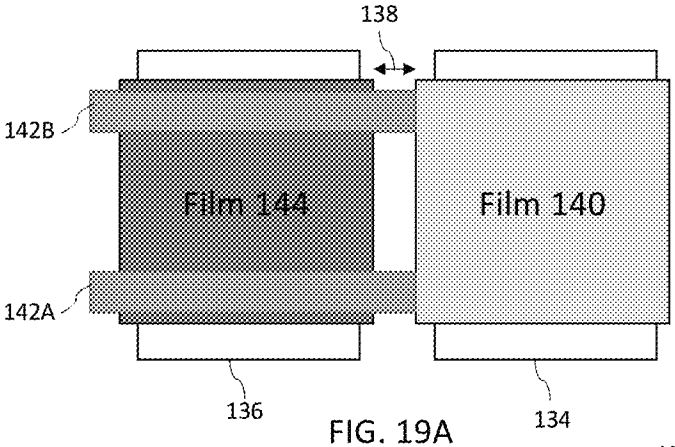
Figure 19C:
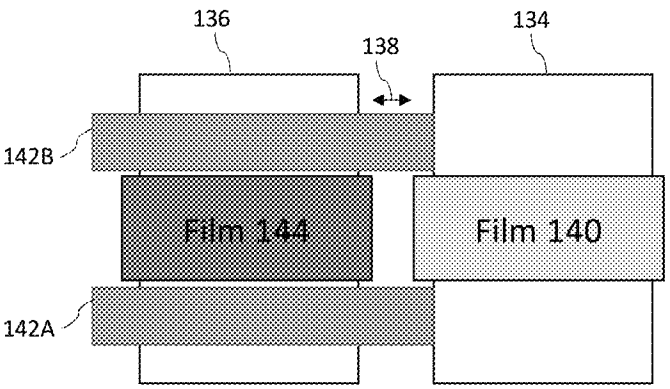

FIGS. 19A-19C illustrate these different arrangements of the microwires with respect to rollers 134 and 136 and films 140, 144 engaged therewith. In FIG. 19A, the microwires, 142A and 142B, are positioned between both the rollers, 134 and 136, and both the films, 140 and 144. Thus, the thickness of the microwires serves to define the gap 138. In FIG. 19B, the width of film 140 is narrower than the spacing between the microwires 142A and 142B, hence, the microwires contact roller 134 outside of the film 140 (e.g., near the edges of roller 134). The width of gap 138 is defined by both the thickness of the microwires 142A and 142B and the thickness of film 144. In FIG. 19C, the microwires contact roller 134 outside of the film 140 (e.g., near the edges of roller 134) and contact roller 136 outside of the film 144 (e.g., near the edges of roller 136). The width of gap 138 is defined by both the thickness of the microwires 142A and 142B and the thickness of films 140 and 144.

In various embodiments then, the invention provides:

Embodiment 1

A dispensing unit for dispensing liquid material, said unit comprising: a hollow reservoir configured to accommodate a syringe and including an elongated nipple at one end of the reservoir, said nipple providing a fluid path for liquid material dispensed from the syringe when supported in said reservoir and having holes disposed near an end thereof; a piston including a shaft disposed therein; and a bracket adapted to receive the nipple of the reservoir such that the fluid path for the liquid material is oriented towards a nozzle disposed in the bracket, and to receive the piston oriented with respect to the nipple of the reservoir such that the shaft is aligned with the holes in the nipple and the nozzle, the shaft thereby being displaceable through said holes towards said nozzle.

Embodiment 2

The dispensing unit as in embodiment 1, wherein the bracket includes rail mounts adapted to interface with rails of a dispenser system.

Embodiment 3

The dispensing unit as in embodiment 1, wherein the piston includes a nib at a top of the piston, and an air nipple positioned along a longitudinal length of the piston, a hollow shaft of the piston that extends through the shaft being in fluid communication with the air nipple.

Embodiment 4

The dispensing unit as in embodiment 1, further comprising the syringe received within the reservoir, said syringe including a plunger and having a cap.

Embodiment 5

A dispensing system comprising one or more dispensing units as in embodiment 1, the dispensing units arranged so as to be laterally displaceable along a length of the dispensing system defined by a lead screw, a first motor configured to drive the lead screw so as to displace the dispensing units along its length, and means for selectively actuating pistons of the dispensing units so as to displace respective ones of the shafts of the pistons of the dispensing units with respect to the nozzles of the brackets of the dispensing units.

Embodiment 6

The dispensing system as in embodiment 5, wherein the means for selectively actuating pistons of the dispensing units comprise a piston nib capture unit translatable within a piston capture block parallel to a longitudinal axis of respective ones of the pistons of the dispensing units, a second motor coupled to rotate a piston displacement shaft clockwise or counterclockwise, said piston displacement shaft having disposed at an end thereof a piston displacement cam, wherein the piston nib capture unit contains a cam recess to receive the piston displacement cam and includes a slotted recess to receive a nib of a respective one of the shafts of the pistons when disposed over said respective one of the shafts, such that when the piston displacement cam rotates with the piston displacement shaft, the piston nib capture unit is translated in a direction defined by the longitudinal axis of the pistons and any respective piston nib at a top of a respective one of the pistons that is secured within the slotted recess is also translated along that respective piston's longitudinal axis.

Embodiment 7

The dispensing system as in embodiment 6, wherein the end of the piston displacement shaft is offset from an axis of rotation of the piston displacement shaft and the piston displacement cam is oval in shape.

Embodiment 8

The dispensing system as in embodiment 6, wherein the piston nib capture unit containing the cam recess is fixed so as to remain stationary along an axis orthogonal to the longitudinal axis of the respective ones of the pistons.

Embodiment 9

The dispensing system as in embodiment 6, further comprising a third motor coupled to rotate a piston stroke shaft, wherein said piston stroke shaft has at one end thereof a piston stroke cam positioned so as to engage a displaceable cam along the piston displacement shaft, said displaceable cam abutting a spring loaded wedge connected to the piston displacement cam so that movement of the displaceable cam through engagement with the piston stroke cam forces open the wedge thereby moving a center of rotation of the piston displacement cam radially away from an axis of rotation of the piston displacement shaft.

Embodiment 10

A process for dispensing materials, comprising: filling one or more syringes with liquid materials of interest and subsequently placing each of the syringes in a respective one of a plurality of reservoirs of a dispenser unit; setting respective pressures of the syringes for dispensing droplets of the liquid materials of interest when respective piston shafts of pistons associated with the plurality of reservoirs are activated; programming a control unit of the dispenser unit with a desired print pattern of the liquid materials of interest, the control unit being coupled to a plurality of actuators of the dispenser unit; setting an eccentricity of a piston displacement cam of the dispenser unit, said eccentricity defining a piston shaft stroke length of the pistons; and running a printing operation according to the desired print pattern, wherein during said printing operation said actuators effect dispensing of the liquid materials from the reservoirs by displacing ones of the respective piston shafts of the pistons associated with the plurality of reservoirs along their longitudinal lengths thereby creating said droplets of the liquid materials.

Embodiment 11

The process as in embodiment 10, wherein setting respective pressures of the syringes comprises adjusting positions of respective plungers of the one or more syringes.

Embodiment 12

The process as in embodiment 10, further comprising replacing the liquid materials of interest as needed during the printing operation.

Embodiment 13

The process as in embodiment 10, wherein displacement of each respective piston shaft is achieved by way of one of the actuators rotating a shaft, one end of which is offset from its axis of rotation, forcing a piston nib capture unit to be displaced in a direction parallel to an axis of the longitudinal lengths of the pistons as the shaft rotates, said piston nib capture unit capturing a top nib of a selected respective piston in a slotted recess within which top nib is positioned as the piston nib capture unit moves, thereby causing movement of the shaft of the selected respective piston as well.

Embodiment 14

The process as in embodiment 13, wherein a second of the actuators displaces the plurality of reservoirs of the dispensing unit along a length of the dispensing unit between movements of the shafts of each selected respective piston by rotating a lead screw clockwise or counterclockwise.

Embodiment 15

The process as in embodiment 14, further comprising a third of the actuators changing the piston shaft stroke length by changing an offset distance of the end of shaft from its axis of rotation.

Embodiment 16

A coating apparatus, comprising one or more dispensing units as in embodiment 1, the dispensing units arranged so as to apply rheological material from syringes accommodated within respective hollow reservoirs of the dispensing units on a flexible film drawn between a pair of spools, under respective nozzles of the dispensing units and through a gap defined by a pair of rollers of the coating apparatus, said gap defining a thickness of a layer of rheological material applied to the film by being positioned after a coating area in which the rheological material from the syringes is applied to the film in a direction of film travel and being maintained at a desired separation distance between the rollers by microwires suspended through the gap.

Embodiment 17

The coating apparatus as in embodiment 16, further comprising a plurality of microwire holders mounted on rack, said rack slidably secured to a first track formed of one or more rails secured to a rail holder such that a selected microwire holder with a microwire having a desired thickness is positionable adjacent to the gap between the pair of rollers.

Embodiment 18

The coating apparatus as in embodiment 17, wherein each microwire holder is displaceable along respective second tracks in a direction perpendicular to an extent of the first track.

Embodiment 19

The coating apparatus as in embodiment 18, wherein each microwire holder comprises a holder frame to which drums and wire supports are mounted, one end of a respective microwire of each microwire holder being secured to a respective first drum and another end of the respective microwire being secured to a respective second drum, with a middle portion of the respective microwire being supported by wire supports, such that rotation of respective first and second drums about respective axes of rotation adjusts tension of the respective microwire.

Embodiment 20

The coating apparatus as in embodiment 16, wherein the gap is defined by two microwire sub-assemblies, each microwire sub-assembly including racks linearly translatable along rails so as to position selected microwire holders having microwires of desired thickness adjacent to surfaces of said rollers.

Embodiment 21

A coating apparatus, comprising a dispensing unit arranged to apply rheological material on a flexible film drawn through a gap between a pair of rollers of the coating apparatus, said gap defining a thickness of a layer of rheological material applied to the film by being positioned after a coating area in which the rheological material is applied to the film in a direction of film travel, and said gap having a width maintained at a desired separation distance between the rollers by microwires suspended through the gap.

Embodiment 22

The coating apparatus as in embodiment 21, further comprising a plurality of microwire holders mounted on rack, said rack slidably secured to a first track formed of one or more rails secured to a rail holder such that a selected microwire holder with a microwire having a desired thickness is positionable adjacent to the gap between the pair of rollers.

Embodiment 23

The coating apparatus as in embodiment 22, wherein each microwire holder is displaceable along respective second tracks in a direction perpendicular to an extent of the first track.

Embodiment 24

The coating apparatus as in embodiment 23, wherein each microwire holder comprises a holder frame to which drums and wire supports are mounted, one end of a respective microwire of each microwire holder being secured to a respective first drum and another end of the respective microwire being secured to a respective second drum, with a middle portion of the respective microwire being supported by wire supports, such that rotation of respective first and second drums about respective axes of rotation adjusts tension of the respective microwire.

Embodiment 25

The coating apparatus as in embodiment 21, wherein the gap width is defined by two microwire sub-assemblies, each microwire sub-assembly including racks linearly translatable along rails so as to position selected microwire holders having microwires of desired thickness adjacent to surfaces of said rollers.

Embodiment 26

The coating apparatus as in embodiment 21, wherein the microwires are suspended through the gap and in contact with the film.

Embodiment 27

The coating apparatus as in embodiment 21, wherein the microwires are suspended through the gap and in contact with one of the rollers, but not the film.

Embodiment 28

The coating apparatus as in embodiment 21, wherein the microwires are suspended through the gap in contact with each of the pair of rollers but not the film.

Embodiment 29

The coating apparatus as in embodiment 21, wherein the film to which the rheological material is applied is opposed across the gap by a second film.

Embodiment 30

The coating apparatus as in embodiment 29, wherein the microwires are suspended through the gap and in contact with the film to which the rheological material is applied and the second film.

Embodiment 31

The coating apparatus as in embodiment 29, wherein the microwires are suspended through the gap and in contact with one of the rollers, but not the film to which the rheological material is applied.

Embodiment 32

The coating apparatus as in embodiment 29, wherein the microwires are suspended through the gap in contact with each of the pair of rollers but not the film to which the rheological material is applied or the second film.

Embodiment 33

A method of coating a film, comprising dispensing a first rheological material onto a surface of a flexible film while drawing the film through a gap between a pair of rollers, said gap defining a thickness of a layer of the rheological material applied to the film by being positioned after a coating area in which the rheological material is applied to the film in a direction of film travel, and maintaining said gap at a width by positioning first microwires through the gap as the dispensing of the rheological material takes place.

Embodiment 34

The method as in embodiment 33, wherein the film to which the first rheological material is applied is opposed across the gap by a second film and further comprising, adjusting a contact area of the second film across the gap from the film to which the rheological material is applied.

Embodiment 35

The method as in embodiment 34, further comprising after adjusting the contact area of the second film dispensing a second rheological material to the surface of the flexible film.

Embodiment 36

The method as in embodiment 33, further comprising, during dispensing of the first rheological material, adjusting the width of said gap by exchanging the first microwires for second microwires of different thickness than the first microwires through the gap.

Embodiment 37

The method as in embodiment 36, wherein the film to which the first rheological material is applied is opposed across the gap by a second film and further comprising, adjusting a contact area of the second film across the gap from the film to which the rheological material is applied.

Embodiment 38

The method as in embodiment 33, further comprising pausing dispensing of the first rheological material while the exchanging the first microwires for second microwires of different thickness than the first microwires through the gap.

Embodiment 39

The method as in embodiment 38, wherein the film to which the first rheological material is applied is opposed across the gap by a second film and further comprising, adjusting a contact area of the second film across the gap from the film to which the rheological material is applied.

Embodiment 40

The method as in embodiment 33, further comprising suspending dispensing of the first rheological material in favor of dispensing a second rheological material onto the surface of the film, and adjusting the width of said gap by exchanging the first microwires for second microwires of different thickness than the first microwires through the gap.

Thus, systems and methods for dispensing liquid materials, for example, as may be used in applications for coating flexible films and the like, and in particular such systems as are configured for dispensing multiple liquid materials from multiple reservoirs have been described.

What is claimed is:

1. A coating apparatus, comprising a dispensing unit arranged to apply rheological material on a flexible film drawn through a gap between a pair of rollers of the coating apparatus, said gap defining a thickness of a layer of rheological material applied to the flexible film by being positioned after a coating area in which the rheological material is applied to the flexible film in a direction of film travel, and said gap having a width maintained at a desired separation distance between the rollers by microwires suspended through the gap.

2. The coating apparatus of claim 1, further comprising a plurality of microwire holders mounted on a rack, said rack slidably secured to a first track formed of one or more rails secured to a rail holder such that a selected microwire holder with a respective microwire having a desired thickness is positionable adjacent to the gap between the pair of rollers.

3. The coating apparatus of claim 2, wherein each microwire holder is displaceable along respective second tracks in a direction perpendicular to an extent of the first track.

4. The coating apparatus of claim 3, wherein each microwire holder comprises a holder frame to which drums and wire supports are mounted, one end of a respective microwire of each microwire holder being secured to a respective first drum and another end of the respective microwire being secured to a respective second drum, with a middle portion of the respective microwire being supported by wire supports, such that rotation of respective first and second drums about respective axes of rotation adjusts tension of the respective microwire.

5. The coating apparatus of claim 1, wherein the gap width is defined by two microwire sub-assemblies, each microwire sub-assembly including racks linearly translatable along rails so as to position selected microwire holders having respective microwires of desired thickness adjacent to surfaces of said rollers.

6. The coating apparatus of claim 1, wherein the microwires are suspended through the gap and in contact with the flexible film.

7. The coating apparatus of claim 1, wherein the microwires are suspended through the gap and in contact with one of the rollers, but not the flexible film.

8. The coating apparatus of claim 1, wherein the microwires are suspended through the gap in contact with each of the pair of rollers but not the flexible film.

9. The coating apparatus of claim 1, wherein the flexible film to which the rheological material is applied is opposed across the gap by a second film.

10. The coating apparatus of claim 9, wherein the microwires are suspended through the gap and in contact with the flexible film to which the rheological material is applied and the second film.

11. The coating apparatus of claim 9, wherein the microwires are suspended through the gap and in contact with one of the rollers, but not the flexible film to which the rheological material is applied.

12. The coating apparatus of claim 9, wherein the microwires are suspended through the gap in contact with each of the pair of rollers but not the flexible film to which the rheological material is applied or the second film.

* * * * *